US008523146B2

(12) United States Patent
Polins et al.

(10) Patent No.: US 8,523,146 B2
(45) Date of Patent: Sep. 3, 2013

(54) DEVICE, SYSTEM, AND METHOD FOR LIFTING A MOTOR VEHICLE

(75) Inventors: Kurt E. Polins, Baltimore, MD (US); Glenn D. Felpel, Powell, TN (US); Allan Pavlick, Middletown, NY (US)

(73) Assignee: Stertil Koni USA, Stevensville, MD (US)

( * ) Notice: Subject to any disclaimer, the term of this patent is extended or adjusted under 35 U.S.C. 154(b) by 0 days.

(21) Appl. No.: 13/468,379

(22) Filed: May 10, 2012

(65) Prior Publication Data

US 2012/0263570 A1 Oct. 18, 2012

Related U.S. Application Data

(62) Division of application No. 11/596,793, filed as application No. PCT/US2005/017320 on May 17, 2005, now Pat. No. 8,191,865.

(60) Provisional application No. 60/571,829, filed on May 17, 2004.

(51) Int. Cl.
*B66F 7/06* (2006.01)

(52) U.S. Cl.
USPC ..... 254/122; 254/126

(58) Field of Classification Search
USPC ..... 254/122, 45, 124, 126; 187/205
See application file for complete search history.

(56) References Cited

U.S. PATENT DOCUMENTS

| | | | | |
|---|---|---|---|---|
| 1,539,974 | A | 6/1925 | Tucker | |
| 2,412,158 | A * | 12/1946 | Kuehlman et al. | 414/495 |
| 2,503,347 | A | 4/1950 | Miller | |
| 2,533,980 | A | 12/1950 | Weaver | |
| 2,935,218 | A | 5/1960 | Fritz | |
| 3,110,476 | A | 11/1963 | Farris | |
| 3,350,065 | A | 10/1967 | Mankey | |
| 3,700,070 | A | 10/1972 | King | |
| 3,796,282 | A | 3/1974 | Denier et al. | |
| 3,891,108 | A * | 6/1975 | Traficant | 254/45 |
| 3,892,142 | A | 7/1975 | Karls et al. | |
| 4,092,111 | A | 5/1978 | Gaignoux et al. | |
| 4,175,644 | A | 11/1979 | Sikli | |
| 4,194,723 | A | 3/1980 | Grove et al. | |
| 4,221,280 | A | 9/1980 | Richards | |
| 4,447,041 | A | 5/1984 | Fujita | |

(Continued)

FOREIGN PATENT DOCUMENTS

EP 0 115 087 A 8/1984

OTHER PUBLICATIONS

Photo 1 "DSC01844" Light Weight scissor lift of the type believed to exist before the cirtical date of the present application. Photo taken on or around Mar.-Apr. 4, 2011.

(Continued)

*Primary Examiner* — Lee D Wilson
(74) *Attorney, Agent, or Firm* — Woodcock Washburn LLP

(57) ABSTRACT

A preferred embodiment of a system includes a lifting device for lifting a motor vehicle, a support structure for mounting the lifting device in a pit, and a carriage for supporting the lifting device from the support structure and being movable within the support structure. The system also includes a cover coupled to opposite sides of the carriage so that the cover extends away from the carriage and continuously between the opposite sides of the carriage.

26 Claims, 33 Drawing Sheets

(56) References Cited

U.S. PATENT DOCUMENTS

| | | | | |
|---|---|---|---|---|
| 4,457,403 | A | 7/1984 | Ream | |
| 4,625,830 | A | 12/1986 | Wehmeyer et al. | |
| 4,655,466 | A | 4/1987 | Hanaoka | |
| 4,682,750 | A | 7/1987 | Rudolph et al. | |
| 4,684,314 | A | 8/1987 | Luth | |
| 4,688,760 | A | 8/1987 | Garman et al. | |
| 4,718,519 | A | 1/1988 | Barker | |
| 4,815,712 | A | 3/1989 | Kawada | |
| 4,830,147 | A | 5/1989 | Kawada | |
| 4,858,482 | A | 8/1989 | Knudsen | |
| 4,858,888 | A | 8/1989 | Cruz et al. | |
| 4,886,145 | A | 12/1989 | Iwahashi | |
| 4,890,692 | A | 1/1990 | Oakman | |
| 4,901,980 | A | 2/1990 | Hansen | |
| 4,921,074 | A | 5/1990 | Ochs | |
| 4,930,598 | A | 6/1990 | Murrill et al. | |
| 5,105,915 | A | 4/1992 | Gary | |
| 5,131,501 | A | 7/1992 | Yoshikawa | |
| 5,192,053 | A | 3/1993 | Sehlstedt | |
| 5,222,717 | A | 6/1993 | Traficant | |
| 5,259,482 | A | 11/1993 | Prouix et al. | |
| 5,263,412 | A | 11/1993 | Chenard et al. | |
| 5,299,906 | A | 4/1994 | Stone | |
| 5,316,133 | A | 5/1994 | Moser | |
| 5,322,143 | A | 6/1994 | Curran | |
| 5,394,959 | A | 3/1995 | Cullity et al. | |
| 5,397,209 | A | 3/1995 | Heim | |
| 5,404,968 | A | 4/1995 | Fletcher | |
| 5,460,460 | A | 10/1995 | Alexander | |
| 5,500,968 | A * | 3/1996 | Hodges | 14/71.7 |
| 5,525,019 | A | 6/1996 | Moore et al. | |
| 5,636,711 | A | 6/1997 | Nussbaum | |
| 5,695,173 | A | 12/1997 | Ochoa et al. | |
| 5,740,886 | A | 4/1998 | Fletcher | |
| 5,802,651 | A * | 9/1998 | Massey et al. | 14/71.3 |
| 5,860,491 | A | 1/1999 | Fletcher | |
| 5,967,494 | A | 10/1999 | Fiorese | |
| 6,024,528 | A | 2/2000 | Taylor | |
| 6,182,796 | B1 | 2/2001 | Perlstein et al. | |
| 6,244,390 | B1 | 6/2001 | Yeo et al. | |
| 6,257,372 | B1 | 7/2001 | Schirmer | |
| 6,354,769 | B1 * | 3/2002 | Allen | 405/303 |
| 6,405,997 | B1 | 6/2002 | Granata | |
| 6,431,319 | B1 | 8/2002 | Myers et al. | |
| 6,464,205 | B2 | 10/2002 | Wanner | |
| 6,471,009 | B1 | 10/2002 | Mabry et al. | |
| 6,484,554 | B2 | 11/2002 | Soyk | |
| 6,595,322 | B2 | 7/2003 | Winter | |
| 6,601,430 | B2 | 8/2003 | McClellan | |
| 6,601,826 | B1 * | 8/2003 | Granata | 254/122 |
| 6,672,430 | B2 | 1/2004 | Boucher et al. | |
| 6,679,479 | B1 | 1/2004 | Watkins | |
| 1,991,255 | A1 | 2/2005 | Martin | |
| 6,974,123 | B2 | 12/2005 | Latvys | |
| 7,028,811 | B2 * | 4/2006 | Rauch | 187/205 |
| 7,225,898 | B2 * | 6/2007 | Bourgeois | 187/200 |
| 7,311,295 | B2 | 12/2007 | Ha | |
| 7,810,788 | B2 * | 10/2010 | DeVries | 254/126 |
| 2003/0051946 | A1 | 3/2003 | Chen et al. | |
| 2003/0066334 | A1 | 4/2003 | McClellan | |
| 2003/0189194 | A1 | 10/2003 | Latvys | |
| 2004/0045338 | A1 | 3/2004 | Dobbins et al. | |
| 2008/0224107 | A1 * | 9/2008 | Polins et al. | 254/45 |

OTHER PUBLICATIONS

Photo 2, "DSC0'1 845", Prior art light weight scissor lifts, Photo taken on or around Mar.-Apr. 4, 2011.

Photo 3, "OSC01846", Name plate of the scissor lift in item 80 {Photo 2} showing date (bouwjaar) of the lift as "1997".

UK Platforms Jims, "Rough Terrain Scissor lifts", Product brochure, published Mar. 2006, 2 pages. Lightweight scissor lift of the type believed to exist before the critical date of present application.

APi Supply Lifts, "Aerial lifts", accessed online at website apisupplyinc.com. 2010, 1 page. Lightweight scissor lift of the type believed to exist before the Critical date of the present application.

Aerial Lift, "Genie Aerial Lifts", accessed online at website aerialift.com, 2010, 1 page Ariel lift of the type believed to exist before the critical date of the present application.

Aerial Lift, "Genie Scissor Lift:- Hydraulic Scissor Lifts", accessed online at website aerialitt.com, 2010, 2 pages. Scissor lift of the type believed to exist before the critical date of the present application.

Vancouver Best Painters. "AU About Painting: Ladder and Fall Protection", accessed online at website vancowversbestpainters.com, 1997, 3 pages. Showing outline of lightweight scissor lift of tMI type believed to exist before the critical date of the present application.

Toy Wonders, Inc., "JLG Aerial Work Platform Series 1 -Rough Terrain Scissor lift (1:32, Orange) 3394RT", accessed online at website toywonders.com, 1997-2011, 4 pages. Showing a toy scissor lift: of the type believed to exist before the critical date of the present application.

Commercial Trucks & Equipment Sales, "JLG 1930 18' Scissor Lift", accessed online at s website ctesales.com, 2012, 1 page, Showing a scissor lift of the type believed to exist before the critical date of the present application.

Rent It Today, "Bellingham Scissor Lift: Rental -Gas Scissor Lifts for Rent—Washington Aerial Equipment Rentals", accessed online at website rentittoday.com, 2012, 3 pages. Showings scissor lift of tha type believed to exist before the critical date of the present application.

AUtec, "AUtec 94," Product Brochure, published 1994, 13 pages.

Blitz, "Blitz Price List Truck Lifting Technology No. 1102 G," Product Brochure, published 2002, 11 pages.

In the United States Patent and Trademark Office, "Third Party Submission Under 37 C.F.R § 1.99", 2 pages.

O.M.E.R. S.p.A., "Omer Viva 44," Product Brochure, published 1999, 6 pages.

Rotary Lift, "Brake Work, Chasis Repair, Suspension Work, Tire Work, Steering Repair," Product Brochure, published 1995, 2 pages.

Rotary Lift, "Heavy Duty Lifts," Product Brochure, published 2002, 12 pages.

Rotary Lift, "Lube Pit Equipment Bulletin," Product Brochure, published 1996, 4 pages.

Rotary Lift, "Truck and Bus Lifts," Product Brochure, published 1986, 3 pages.

* cited by examiner

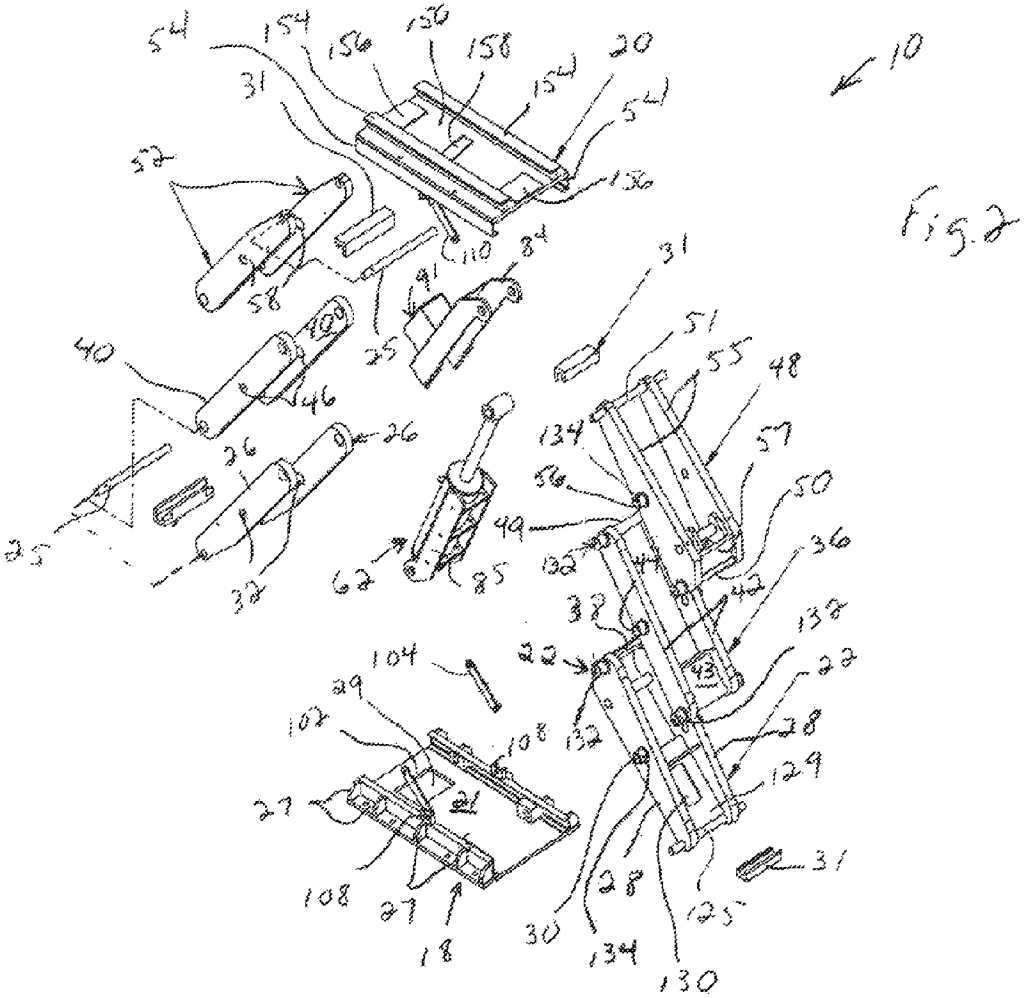

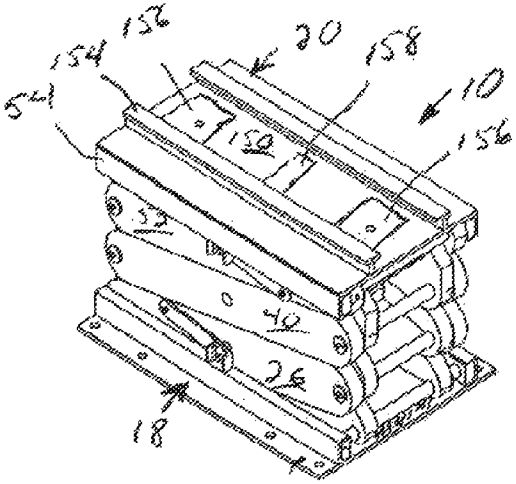
Fig. 3A
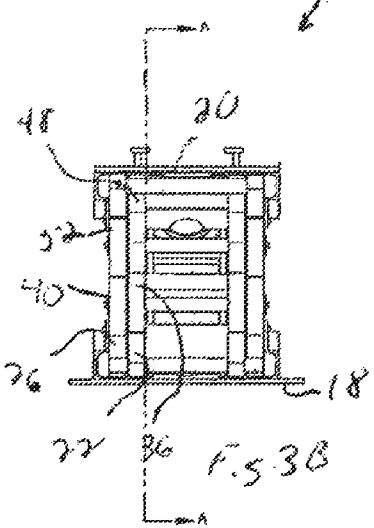
Fig. 3B
Fig. 3C
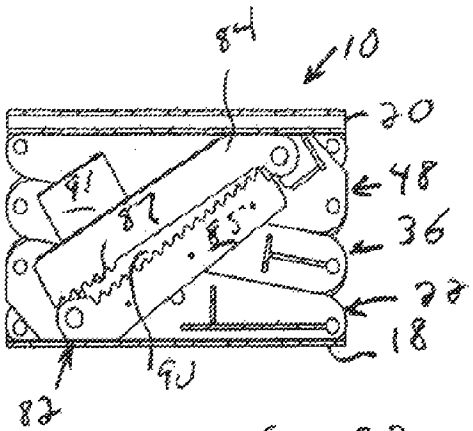
Fig. 3D

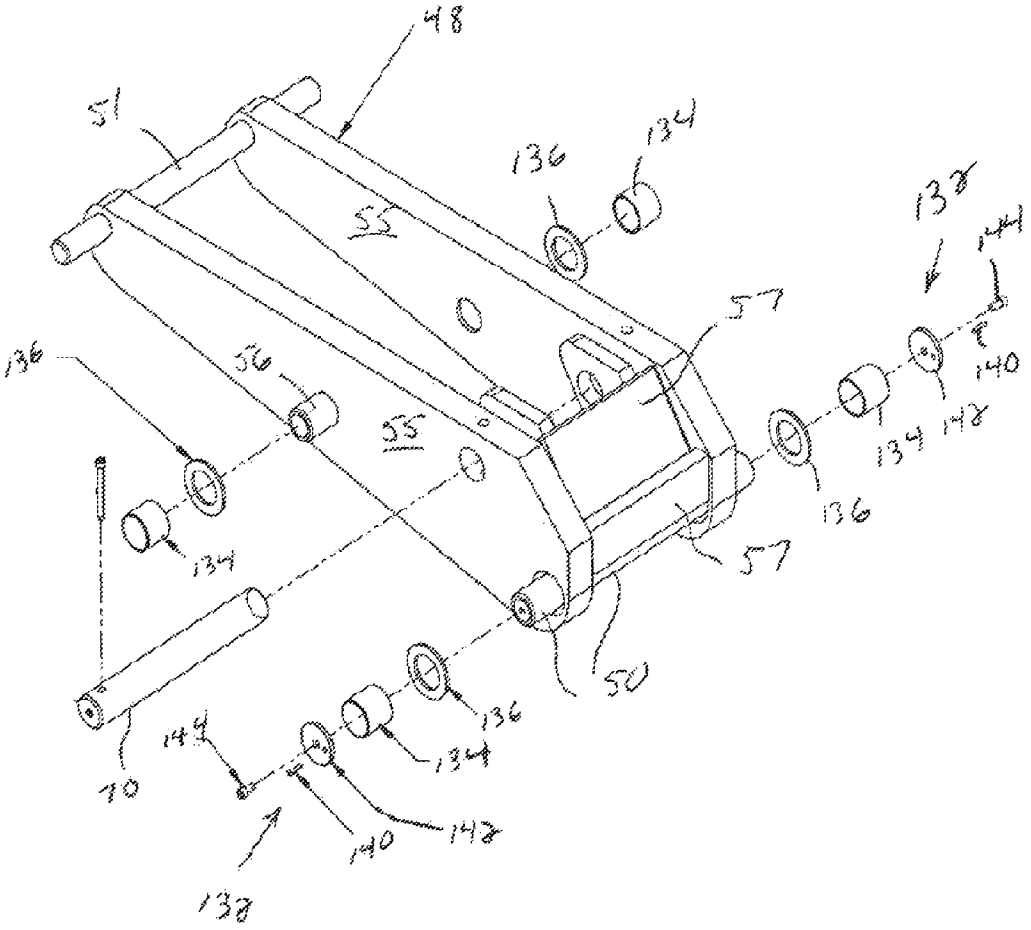
48
51
53
55
57
57
55
53
136
136
136

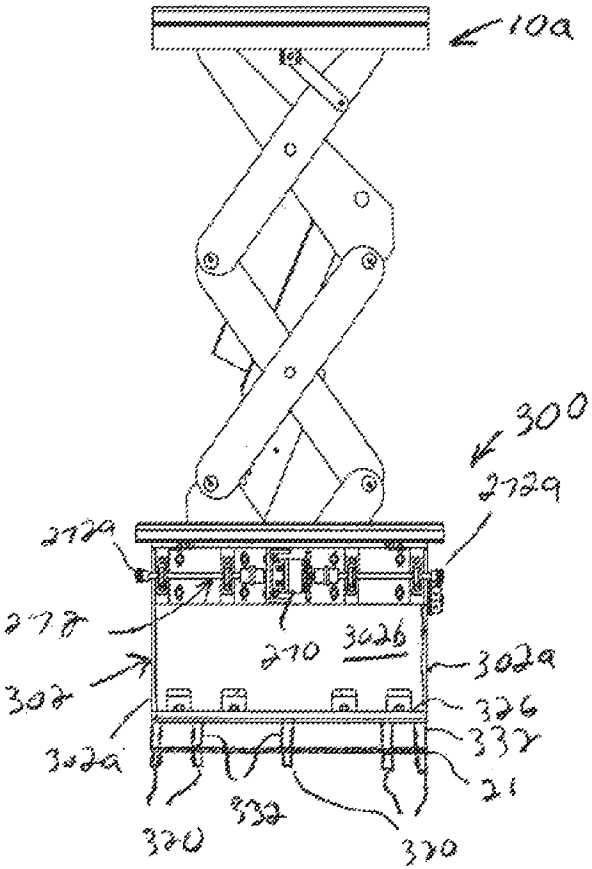
10a
300
302a
302b
302c
302d
302e
302f
302g
302h
302i
302j
302k
302l
302m
302n
302o
302p
302q
302r
302s
302t
302u
302v
302w
302x
302y
302z
302aa
302ab
302ac
302ad
302ae
302af
302ag
302ah
302ai
302aj
302ak
302al
302am
302an
302ao
302ap
302aq
302ar
302as
302at
302au
302av
302aw
302ax
302ay
302az
302ba
302bb
302bc
302bd
302be
302bf
302bg
302bh
302bi
302bj
302bk
302bl
302bm
302bn
302bo
302bp
302bq
302br
302bs
302bt
302bu
302bv
302bw
302bx
302by
302bz
302ca
302cb
302cc
302cd
302ce
302cf
302cg
302ch
302ci
302cj
302ck
302cl
302cm
302cn
302co
302cp
302cq
302cr
302cs
302ct
302cu
302cv
302cw
302cx
302cy
302cz
302da
302db
302dc
302dd
302de
302df
302dg
302dh
302di
302dj
302dk
302dl
302dm
302dn
302do
302dp
302dq
302dr
302ds
302dt
302du
302dv
302dw
302dx
302dy
302dz
302ea
302eb
302ec
302ed
302ee
302ef
302eg
302eh
302ei
302ej
302ek
302el
302em
302en
302eo
302ep
302eq
302er
302es
302et
302eu
302ev
302ew
302ex
302ey
302ez
302fa
302fb
302fc
302fd
302fe
302ff
302fg
302fh
302fi
302fj
302fk
302fl
302fm
302fn
302fo
302fp
302fq
302fr
302fs
302ft
302fu
302fv
302fw
302fx
302fy
302fz
302ga
302gb
302gc
302gd
302ge
302gf
302gg
302gh
302gi
302gj
302gk
302gl
302gm
302gn
302go
302gp
302gq
302gr
302gs
302gt
302gu
302gv
302gw
302gx
302gy
302gz
302ha
302hb
302hc
302hd
302he
302hf
302hg
302hh
302hi
302hj
302hk
302hl
302hm
302hn
302ho
302hp
302hq
302hr
302hs
302ht
302hu
302hv
302hw
302hx
302hy
302hz
302ia
302ib
302ic
302id
302ie
302if
302ig
302ih
302ii
302ij
302ik
302il
302im
302in
302io
302ip
302iq
302ir
302is
302it
302iu
302iv
302iw
302ix
302iy
302iz
302ja
302jb
302jc
302jd
302je
302jf
302jg
302jh
302ji
302jj
302jk
302jl
302jm
302jn
302jo
302jp
302jq
302jr
302js
302jt
302ju
302jv
302jw
302jx
302jy
302jz
302ka
302kb
302kc
302kd
302ke
302kf
302kg
302kh
302ki
302kj
302kk
302kl
302km
302kn
302ko
302kp
302kq
302kr
302ks
302kt
302ku
302kv
302kw
302kx
302ky
302kz
302la
302lb
302lc
302ld
302le
302lf
302lg
302lh
302li
302lj
302lk
302ll
302lm
302ln
302lo
302lp
302lq
302lr
302ls
302lt
302lu
302lv
302lw
302lx
302ly
302lz
302ma
302mb
302mc
302md
302me
302mf
302mg
302mh
302mi
302mj
302mk
302ml
302mm
302mn
302mo
302mp
302mq
302mr
302ms
302mt
302mu
302mv
302mw
302mx
302my
302mz
302na
302nb
302nc
302nd
302ne
302nf
302ng
302nh
302ni
302nj
302nk
302nl
302nm
302nn
302no
302np
302nq
302nr
302ns
302nt
302nu
302nv
302nw
302nx
302ny
302nz
302oa
302ob
302oc
302od
302oe
302of
302og
302oh
302oi
302oj
302ok
302ol
302om
302on
302oo
302op
302oq
302or
302os
302ot
302ou
302ov
302ow
302ox
302oy
302oz
302pa
302pb
302pc
302pd
302pe
302pf
302pg
302ph
302pi
302pj
302pk
302pl
302pm
302pn
302po
302pp
302pq
302pr
302ps
302pt
302pu
302pv
302pw
302px
302py
302pz
302qa
302qb
302qc
302qd
302qe
302qf
302qg
302qh
302qi
302qj
302qk
302ql
302qm
302qn
302qo
302qp
302qq
302qr
302qs
302qt
302qu
302qv
302qw
302qx
302qy
302qz
302ra
302rb
302rc
302rd
302re
302rf
302rg
302rh
302ri
302rj
302rk
302rl
302rm
302rn
302ro
302rp
302rq
302rr
302rs
302rt
302ru
302rv
302rw
302rx
302ry
302rz
302sa
302sb
302sc
302sd
302se
302sf
302sg
302sh
302si
302sj
302sk
302sl
302sm
302sn
302so
302sp
302sq
302sr
302ss
302st
302su
302sv
302sw
302sx
302sy
302sz
302ta
302tb
302tc
302td
302te
302tf
302tg
302th
302ti
302tj
302tk
302tl
302tm
302tn
302to
302tp
302tq
302tr
302ts
302tt
302tu
302tv
302tw
302tx
302ty
302tz
302ua
302ub
302uc
302ud
302ue
302uf
302ug
302uh
302ui
302uj
302uk
302ul
302um
302un
302uo
302up
302uq
302ur
302us
302ut
302uv
302uw
302ux
302uy
302uz
302va
302vb
302vc
302vd
302ve
302vf
302vg
302vh
302vi
302vj
302vk
302vl
302vm
302vn
302vo
302vp
302vq
302vr
302vs
302vt
302vu
302vv
302vw
302vx
302vy
302vz
302wa
302wb
302wc
302wd
302we
302wf
302wg
302wh
302wi
302wj
302wk
302wl
302wm
302wn
302wo
302wp
302wq
302wr
302ws
302wt
302wu
302wv
302ww
302wx
302wy
302wz
302xa
302xb
302xc
302xd
302xe
302xf
302xg
302xh
302xi
302xj
302xk
302xl
302xm
302xn
302xo
302xp
302xq
302xr
302xs
302xt
302xu
302xv
302xw
302xx
302xy
302xz
302ya
302yb
302yc
302yd
302ye
302yf
302yg
302yh
302yi
302yj
302yk
302yl
302ym
302yn
302yo
302yp
302yq
302yr
302ys
302yt
302yu
302yv
302yw
302yx
302yy
302yz
302za
302zb
302zc
302zd
302ze
302zf
302zg
302zh
302zi
302zj
302zk
302zl
302zm
302zn
302zo
302zp
302zq
302zr
302zs
302zt
302zu
302zv
302zw
302zx
302zy
302zz

DEVICE, SYSTEM, AND METHOD FOR LIFTING A MOTOR VEHICLE

CROSS REFERENCE TO RELATED APPLICATIONS

This application is a divisional of U.S. patent application Ser. No. 11/596,793 filed Mar. 5, 2008, which is the National Stage of International Application No. PCT/US2005/017320, filed May 17, 2005, which claims the benefit of U.S. Provisional Application No. 60/571,829, filed May 17, 2004, each of which is herein incorporated by reference in its entirety.

TECHNICAL FIELD

The present invention relates to devices and systems for lifting a motor vehicle, such a bus, to facilitate maintenance or service operations on the motor vehicle.

BACKGROUND

Hydraulically-powered lifts are commonly used at maintenance facilities and service stations to lift buses, trucks, automobiles, and other types of motor vehicles. Lifting a motor vehicle is often necessary when performing service or maintenance operations such as tire or brake replacement, or tasks that require access to the underside of the motor vehicle.

Conventional hydraulic lifts typically comprise a hydraulic cylinder. The hydraulic cylinder includes a casing, and piston telescopically disposed within the casing. Pressurized hydraulic fluid is directed into the casing, so that the fluid acts against a first end of the piston. The force of the fluid on the piston causes the piston to extend from the casing. A superstructure suitable for engaging the motor vehicle can be mounted on the opposing end of the piston, so that extension of the piston from the casing urges the superstructure into the motor vehicle, and thereby lifts the motor vehicle.

The casing is typically located below the surface of the floor of the shop or service area, so that the piston can be retracted so as to place the superstructure at or near floor level when the vehicle. Positioning the superstructure in this manner is necessary to permit the motor vehicle to be driven or otherwise positioned over the superstructure. Thus, most or all of the casing must often be located at or below floor level. A relatively deep, e.g., ten-foot deep, trench or hole therefore may be required to accommodate the casing. The need for a relatively deep trench or hole can increase the cost and complexity of the installation, and can make it difficult or unfeasible to install a hydraulically-powdered lift in certain locations, e.g., where the water table or bedrock level is relatively shallow. Moreover, the structure required to support the casing is usually fixed and cast in concrete, with reinforcing bars, further adding to the cost and complexity associated with installing and removing the lift.

The amount of hydraulic fluid needed to operate the above-described lift can be relatively high, e.g., ninety gallons or more. The need to route relatively large amounts of pressurized hydraulic fluid through an underground casing generates a potential for contamination of the surrounding area caused by leakage of the hydraulic fluid. Moreover, the risk of ground contamination can be relatively high in applications wherein the unit that pressurizes and controls the flow of the hydraulic fluid is located within the trench or hole that accommodates the cylinder.

SUMMARY

A preferred embodiment of a system comprises a lifting device for lifting a motor vehicle, a support structure for mounting the lifting device in a pit, and a carriage for supporting the lifting device from the support structure and being movable within the support structure. The system also comprises a cover coupled to opposite sides of the carriage so that the cover extends away from the carriage and continuously between the opposite sides of the carriage.

A preferred method for lifting a motor vehicle comprises positioning the motor vehicle so that a first axle of the motor vehicle is located directly above a first scissors lift located in a first pit, and a second axle of the motor vehicle is located over a second pit having a second scissors lift located therein. The method also comprises positioning the second scissors lift so that the second scissors lift is located directly beneath the second axle, and extending the first and second scissors lifts so that the first and second scissors lifts urge the respective first and second axles upward.

A preferred embodiment of a kit comprises a support structure capable of being installed in a pit so that a lower surface of the support structure rests on a floor of the pit, and fasteners for securing the support structure in place within the pit. The kit also comprises a scissors lift capable of being mounted on the support structure so that the scissors lift can move between an extended position wherein a portion of the scissors lift is extends from the support structure, and a retracted position wherein a substantial entirety of the scissors lift is located within the support structure.

A preferred embodiment of a lifting device comprises a base, a first leg pivotably coupled to the base, a first leg leaf pivotally coupled to the base and the first leg, a bolster, and a second leg pivotally coupled to the bolster. The lifting device also comprise a second leg leaf pivotally coupled to the bolster and the second leg, wherein the second leg is coupled to one of the first leg and the first leg leaf, and the second leg leaf is coupled to the other of the first leg and the first leg leaf so that pivotal movement of the first leg in relation to the first leg leaf and pivotal movement of the second leg in relation to the second leg leaf causes the bolster to rise and lower in relation to the base, and a mating assembly mounted on the bolster for engaging an axle of a motor vehicle.

A preferred embodiment of a vehicle lift comprises a base, and a first tier comprising a first weldment, and two first leg leaves pivotally coupled to the first weldment. The first weldment and the first leg leaves are pivotally coupled to the base. The lifting device also comprises a second tier comprising a second weldment pivotally coupled to the first leg leaves, and two second leg leaves pivotally coupled to the first and second weldments.

The lifting device further comprises a third tier comprising a third weldment pivotally coupled to the second leg leaves, and two third leg leaves pivotally coupled to the second and third weldments. The lifting device also comprises a bolster pivotally coupled to the third weldment and the third leg leaves, and a mating adapter capable of engaging an axle of a motor vehicle so that the vehicle lift can lift the motor vehicle by way of the axle.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings:

FIG. 2 is an exploded perspective view of the lifting device shown in FIG. 1;

FIGS. 3A-3C are front (or rear), side, and perspective views, respectively, of the lifting device shown in FIGS. 1 and 2, depicting the lifting device in a retracted position;

FIG. 3D is a cross-sectional view of the lifting device shown in FIGS. 1-3C, taken through the line "A-A" of FIG. 3B;

FIG. 10 is a perspective view of an inner leg weldment of a third tier of the lifting device shown in FIGS. 1-9;

FIG. 22 is a perspective view of the lifting device, carriage, and cover shown in FIGS. 16, 18, and 20-21B;

FIG. 27 is a front view of the lifting device, carriage, and base shown in FIGS. 16, 18, 20, and 22-26, showing the lifting device in its extended position;

DETAILED DESCRIPTION OF ILLUSTRATIVE EMBODIMENTS

Figure 17:
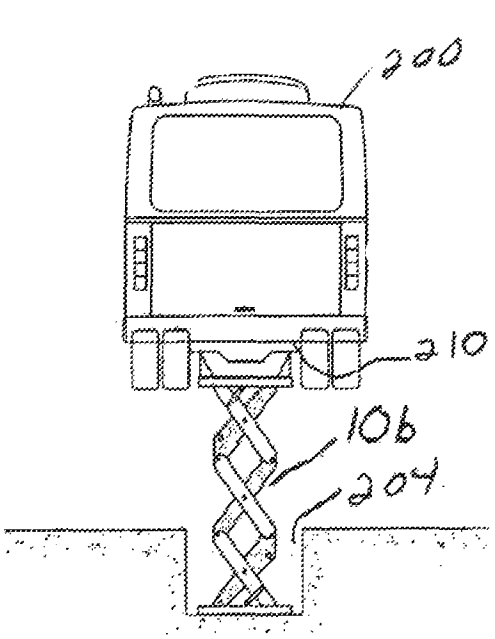
FIG. 17 is a rear view of the installation shown in FIG. 16, depicting the other of the lifting devices installed in a rear pit of the installation, and showing the lifting device in its extended position and lifting the bus.
Figure 18:
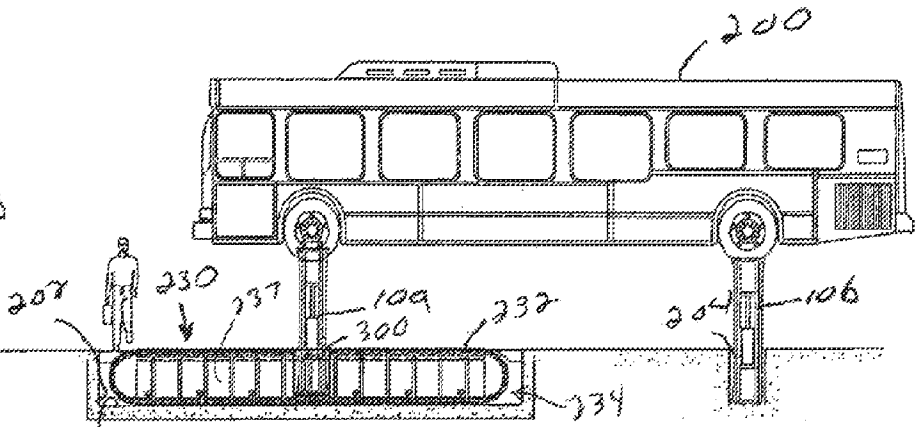
FIG. 18 is a side view of the installation shown in FIGS. 16 and 17, and depicting further details of the installation, including a support structure and carriage assembly for mounting the lifting device in the front pit, and a cover for the support structure.
Figure 19:
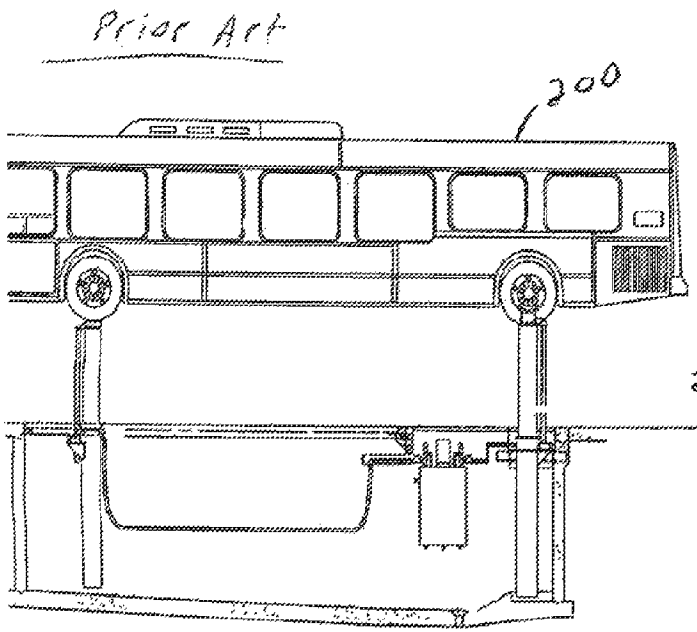
FIG. 19 is a side view of an installation incorporating two conventional lifting devices of comparable capacity to the lifting devices shown in FIGS. 1-6 and 16-18.
Figure 20:
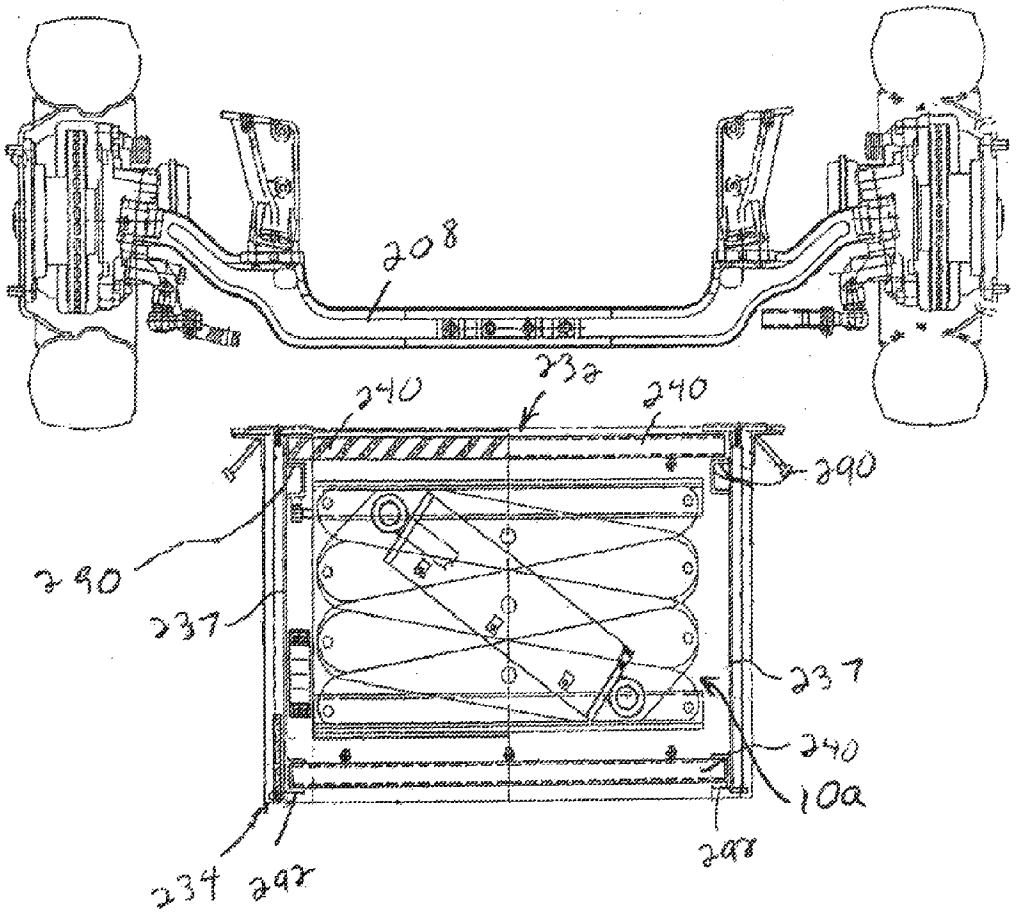
FIG. 20 is a front view of the front pit, lifting device, support structure, cover, and carriage shown in FIGS. 16 and 18, depicting the lifting device in its retracted position.

FIGS. 1-15 depict a preferred embodiment of a lifting device 10 in the form of a scissors jack, and various components thereof. The lifting device 10 can be used to lift a vehicle such as a bus 200, as shown in FIGS. 16-18. The lifting device 10 is believed to be particularly well suited for lifting relatively heavy vehicles such as the bus 200, due to the relatively high lifting capacity and relatively small size of the lifting device 10.

Figure 4:
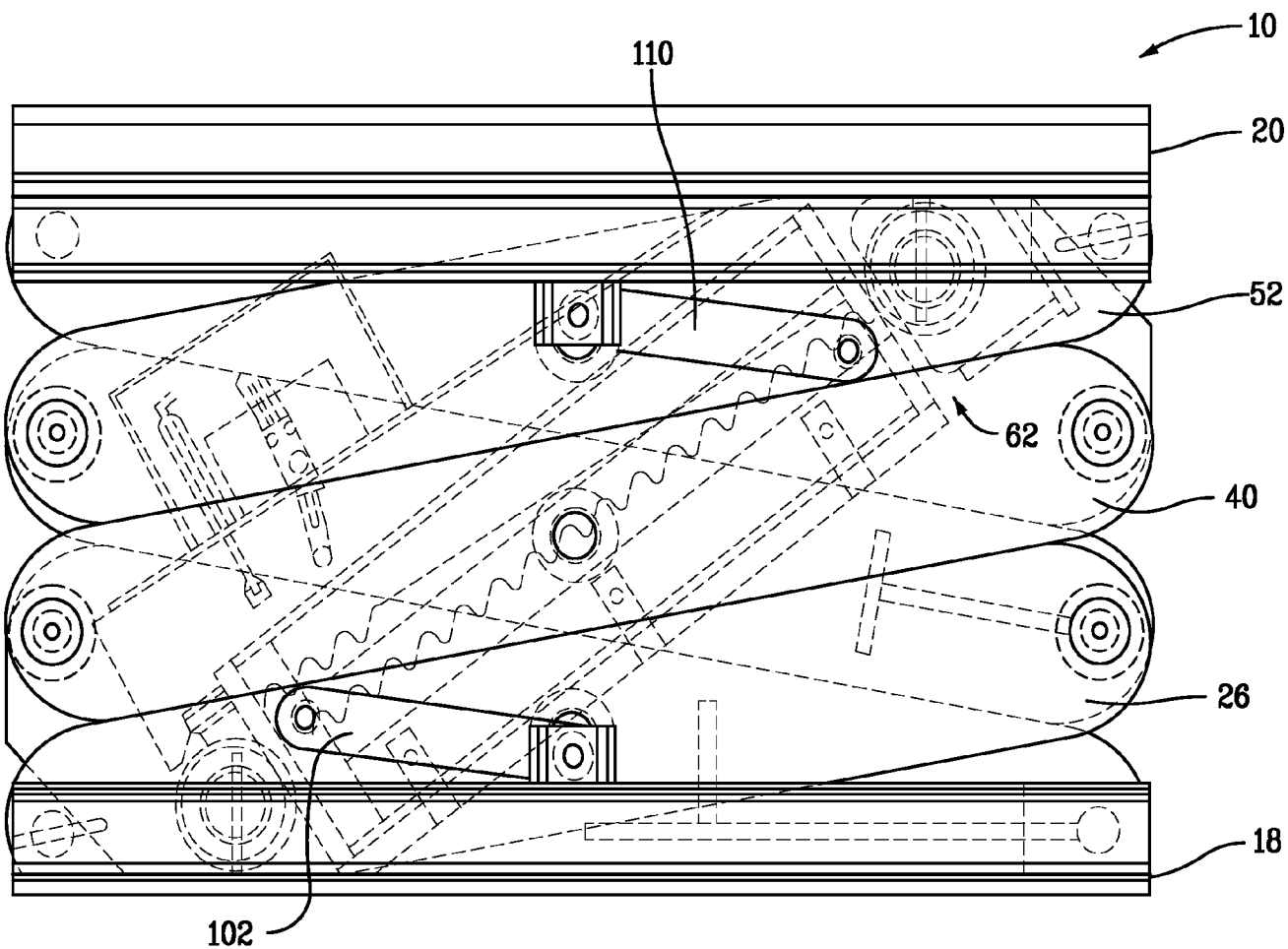
FIG. 4 is a front (or rear) view of the lifting device shown in FIGS. 1-3D, depicting the lifting device in its retracted position.

The lifting device 10 can move between an extended position (FIGS. 1 and 5A-6) and a retracted (collapsed) position (FIGS. 3A-4). The lifting device 10 comprises a first (bottom) tier 12, a second (intermediate) tier 14, and a third (upper) tier 16 (see FIG. 1). The lifting device also comprises a base 18 and a bolster 20.

The base 18 comprises a base plate 21, and two substantially C-shaped channels 24 secured to the base plate 21 by a suitable means such as welding. The base plate 21 can be formed from ¾-inch thick A36 mild steel, or other suitable materials. It should be noted that the optimal value for the thickness of the base plate 21 is application-dependent, and can vary with factors such as the maximum lifting capacity of the device 10. A specific value for the thickness is presented for exemplary purposes only.

Figure 7A:
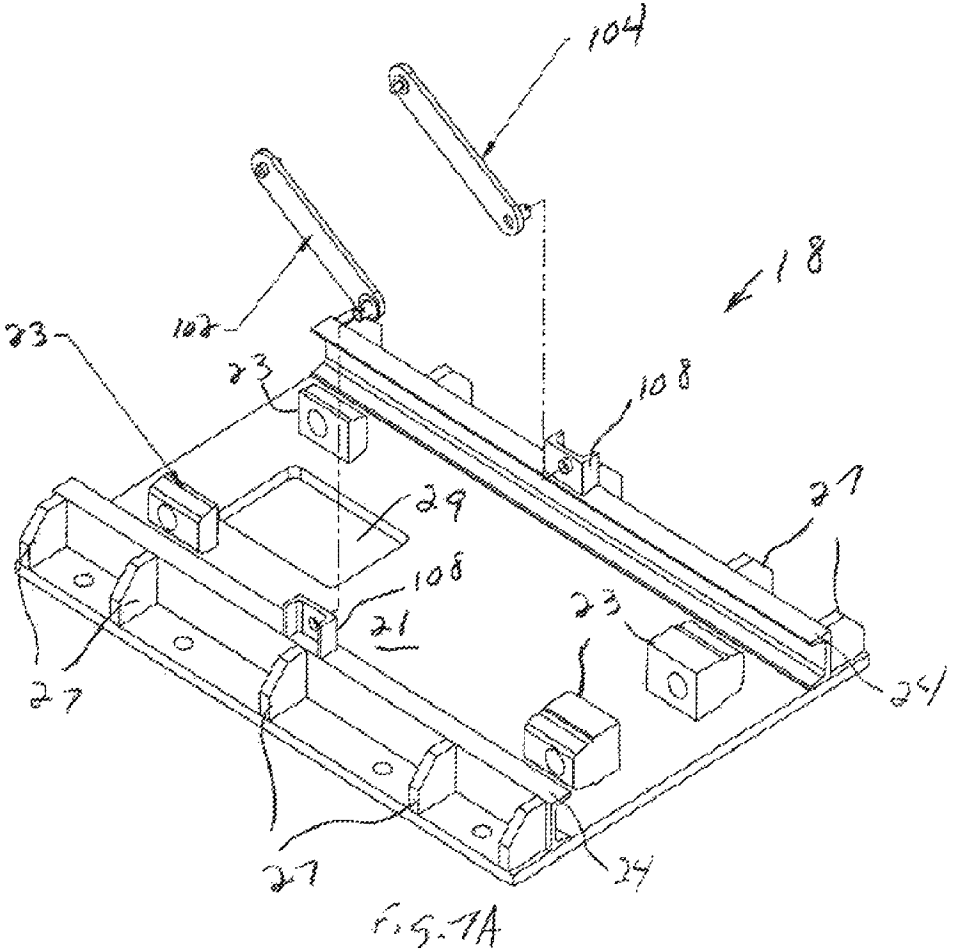
FIG. 7A is a perspective view of a base of the lifting device shown in FIGS. 1-6.
Figure 7B:
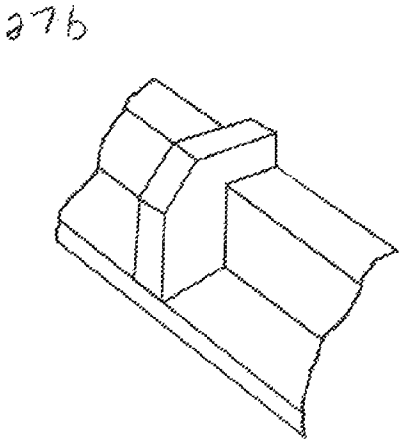
FIG. 7B is a perspective view of an alternative embodiment of a gusset of the base shown in FIG. 7A.

Gussets 27 can be secured to the channels 24 and the base plate 21 by a suitable means such as welding, to help stiffen the channels 24. (An alternative versions of the gussets 27, in the from of a gusset 27*a*, is depicted in FIG. 7B.) The base plate 21 preferably has a cutout 29 formed therein to accommodate lines (not shown) that route hydraulic fluid to and from a hydraulic actuator 62 of the device 10.

The bolster 20 comprises a base plate 150, and two substantially C-shaped channels 54 secured to a lower surface of the base plate 150 by a suitable means such as welding. The base plate 150 can be formed from one-inch thick A514 (T1) high strength steel, or other suitable materials. It should be noted that the optimal value for the thickness of the base plate 150 is application-dependent, and can vary with factors such as the maximum lifting capacity of the device 10. A specific value for the thickness is presented for exemplary purposes only.

Three gussets (not shown) preferably are secured each of the channels 54 and the base plate 150 to help stiffen the channels 54 (the gussets 152 are shown in phantom, in FIG. 3C). The bolster 20 also includes two T-shaped members 154, two retaining plates 156, and a stop 158 each secured to an upper surface of the base plate 150 by a suitable means such as welding. The bolster 20, as discussed below, accommodates a mating assembly 170 that acts as an interface between the device 10, and the bus 200 or other vehicle being lifted by the device 10.

The first tier 12 comprises an inner leg weldment 22. The inner leg weldment 22 comprises two legs 28, and plates, or cross-members 129 secured to each of the legs 28 by a suitable means such as welding. The legs 28 and cross-members 129 can be formed from, for example, A36 mild steel or other suitable materials. (The other structural components of the device 10 can be formed from A36 mild steel or other suitable materials, unless otherwise noted.) One of the cross-members 129 preferably has a cutout 130 formed therein to accommodate flexing of the hydraulic lines that route hydraulic fluid to and from the hydraulic actuator 62.

The inner leg weldment 22 is pivotally coupled to the base 18, i.e., the inner leg weldment 22 is coupled to the base 18 so that the inner leg weldment 22 can pivot in relation to the base 18. More specifically, a first end of each leg 28 of the inner leg weldment 22 can be pivotally to the base 18 by a pair of bearings in the form of slider blocks 23, and a pin 125 secured to each of the legs 28 (see FIGS. 1, 2, and 7). Preferably, the pin 125 is secured to each of the legs 28 by welds formed between the pin 125, and both the inwardly and outwardly facing sides of each leg 28.

Each slider block 23 slides within a corresponding one of the channels 24 as the device 10 moves between its extended and retracted positions. The slider blocks 23 preferably are formed from a material that helps to minimize sliding friction, such as NYLATRON, ultra-high molecular weight polyurethane, or other suitable materials.

The first tier 12 also comprises two outer leg leaves 26. A first end of each outer leg leaf 26 is pivotally coupled to the base 18 by another pair of slider blocks 23 each slidably disposed within a corresponding channel 24, and a pin 25 that extends through each of the outer leg leaves 26. The outer leg leaves 26 can be connected by a cross member (not shown) secured to the outer leg leaves 26 by a suitable means such, as fasteners, to provide the outer leg leaves 26 with additional lateral stiffness. Each outer leg leaf 26 preferably is undercut proximate the first end thereof, as shown in FIG. 2, to facilitate clearance between the outer leg leaf 26 and the base plate 21 of the base 18.

Figure 8:
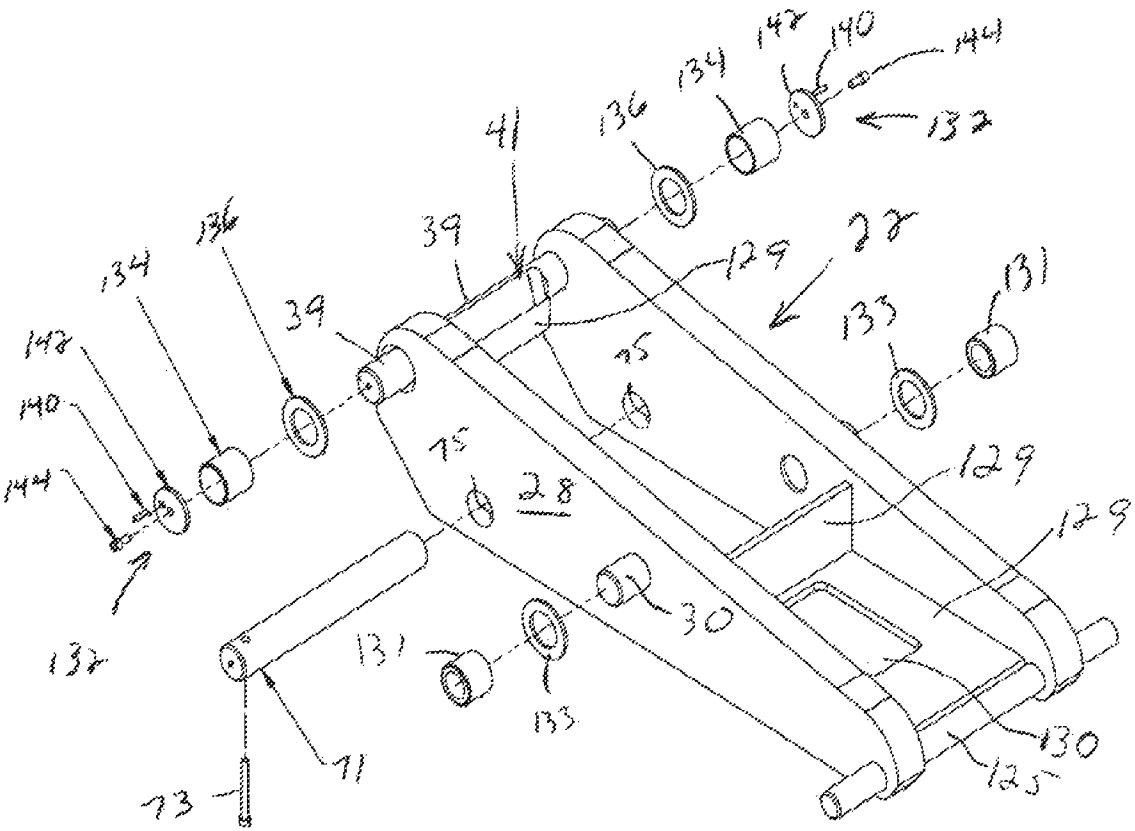
FIG. 8 is a perspective view of an inner leg weldment of a first tier of the lifting device shown in FIGS. 1-7.
Figure 9:
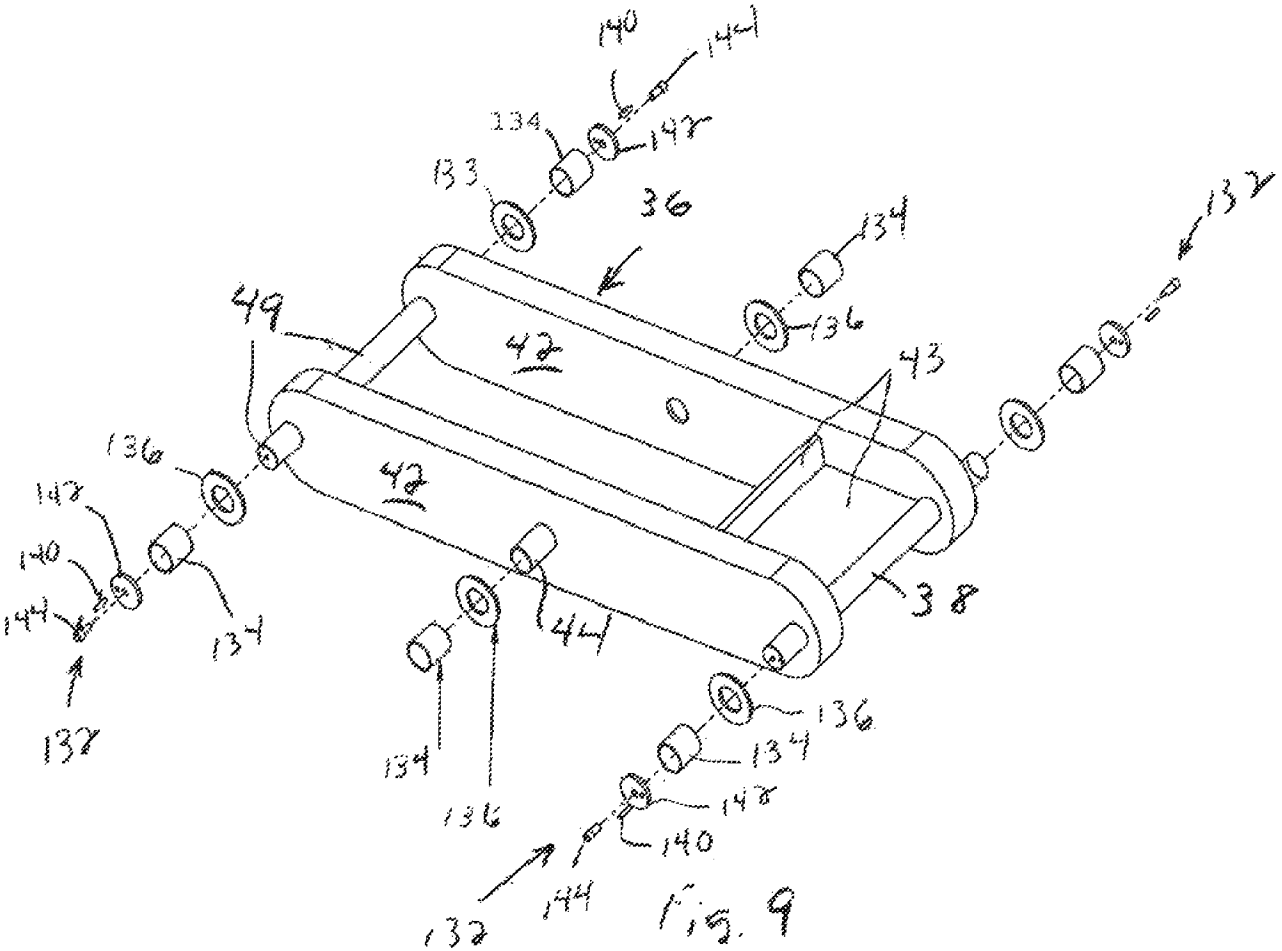
FIG. 9 is a perspective view of an inner leg weldment of a second tier of the lifting device shown in FIGS. 1-8.

A bearing in the form of a sleeve 31 preferably is disposed on both the pin 125 and the pin 25 (see FIG. 2; the sleeves 31 are not depicted in FIG. 8, for clarity). The sleeves 31 contact the base plate 21 of the base 18, and thereby increase the loadbearing area on the pins 125, 25. The sleeves 31 preferably are formed from a material that helps to minimize sliding friction, such as ultra-high molecular weight polyurethane, NYLATRON, or other suitable materials.

Figure 1:
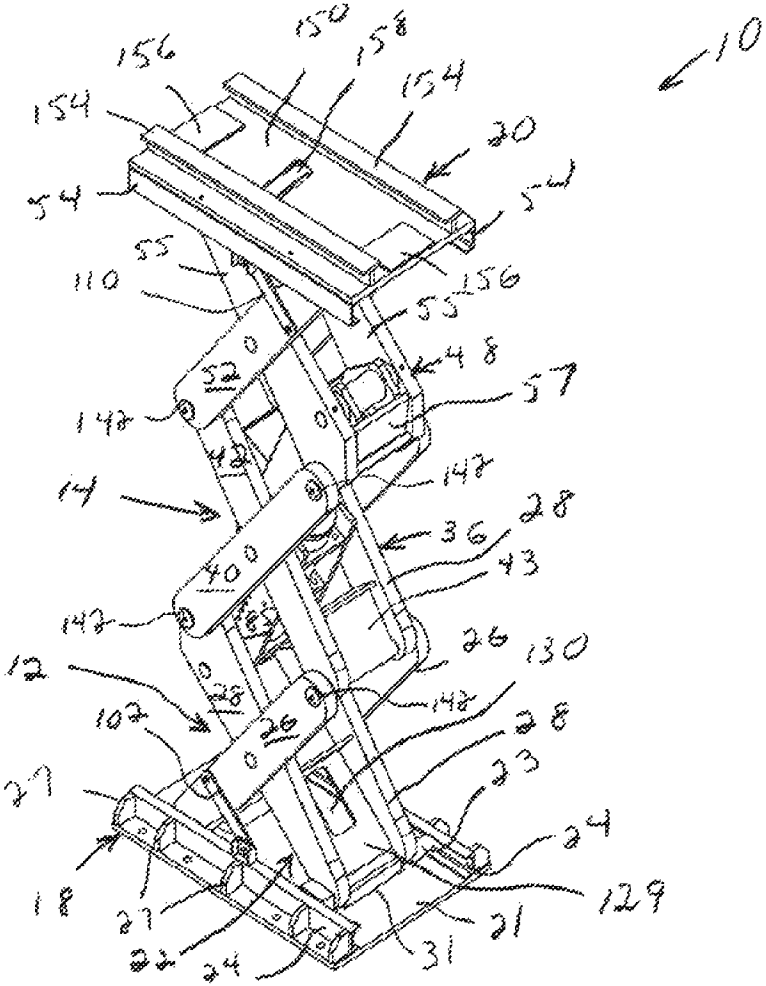
FIG. 1 is a perspective view of preferred embodiment of a lifting device, depicting the lifting device in an extended position.

One of the outer leg leaves 26 is pivotally coupled to a corresponding leg 28 of the inner leg weldment 22, by a suitable means such as a pin 30 attached to the leg 28, and a journal bearing 134 and washer 136 (see FIGS. 1 and 2). The journal bearing 134 can be, for example, a POLYLUBE composite bearing, available from Polygon Co. of Walkerton, Ind.

The pin 30 and the journal bearing 134 preferably are accommodated by a counterbore formed in the leg 28. The pin 30 preferably is positioned proximate a midpoint of the leg 28, and engages the outer leg leaf 26 by way of a hole 32 formed in the outer leg leaf 26, proximate a mid-point thereof. The other outer leg leaf 26 is pivotally coupled to the other leg 28 of the inner leg weldment 22 in a similar manner.

The second tier 14 comprises an inner leg weldment 36. The inner leg weldment 36 includes two legs 42, and plates, or cross-members 43 secured to each of the legs 42 by a suitable means such as welding. A first end of each leg 42 is pivotally coupled to a second end of a corresponding outer leg leaf 26 of the first tier, by a suitable means such as a pin 38 secured to each of the legs 42, and two end cap assemblies 132 (see FIGS. 1, 2, and 8). Preferably, the pin 38 is secured to each of the legs 42 by welds formed between the pin 38, and both the inwardly and outwardly facing sides of each leg 42.

Each end cap assembly 132 preferably comprises one of the journal bearings 134, one of the washers 136, a pin 140, a pin retainer cap 142, and a fastener 144 that securely engages the pin 38.

The second tier 14 also comprises two outer leg leaves 40. A first end of each outer leg leaf 40 is pivotally coupled to a second end of a corresponding leg 28 of the inner leg weldment 22. The outer leg leaves 40 and the legs 28 can be coupled by a suitable means such as a pin 39 secured to the legs 28, and two end cap assemblies 132. Preferably, the pin 38 is secured to each of the legs 28 by welds formed between the pin 39, and both the inwardly and outwardly facing sides of each leg 28. The pin 39 preferably has a cutout 41 formed therein to provide clearance between the pin 39 and the hydraulic actuator 62 of the device 10, as the device 10 moves between its retracted and extended positions.

One of the outer leg leaves 40 is pivotally coupled to a leg 42 of the inner leg weldment 36 by a suitable means such as a pin 44 attached to the leg 42, and another of the journal bearings 134 and washers 136. The pin 44 and the journal bearing 134 preferably are accommodated by a counterbore formed in the leg 42. The pin 44 preferably is positioned proximate a midpoint of the leg 42, and engages the outer leg leaf 40 by way of a hole 46 formed in the leaf 40 proximate a mid-point thereof. The other of the outer leg leaves 40 is pivotally coupled to another leg 42 of the inner leg weldment 36 in a similar manner.

The third tier 16 comprises an inner leg weldment 48. The inner leg weldment 48 includes two legs 55, and plates, or cross-members 57 secured to each of the legs 55 by a suitable means such as welding. Each leg 55 is pivotally coupled to a second end of a corresponding leaf 40 of the second tier, by a pin 50 secured to each of the legs 55, and two of the end cap assemblies 132. Preferably, the pin 50 is secured to the legs 55 by welds formed between the pin 50, and both the inwardly and outwardly facing sides of each leg 55.

The third tier 16 also comprises two outer leg leaves 52. Each of the outer leg leaves 52 is pivotally coupled to a second end of a corresponding leg 42 of the inner leg weldment 36 by a pin 49 secured to the legs 42, and two of the end cap assemblies 132. Preferably, the pin 49 is secured to each of the legs 42 by welds formed between the pin 49, and both the inwardly and outwardly facing sides of each leg 42. Each outer leg leaf 52 preferably is undercut proximate an end thereof, as shown in FIG. 2, to facilitate clearance between the outer leg leaf 52 and the base plate 150 of the bolster 20.

Figure 5C:
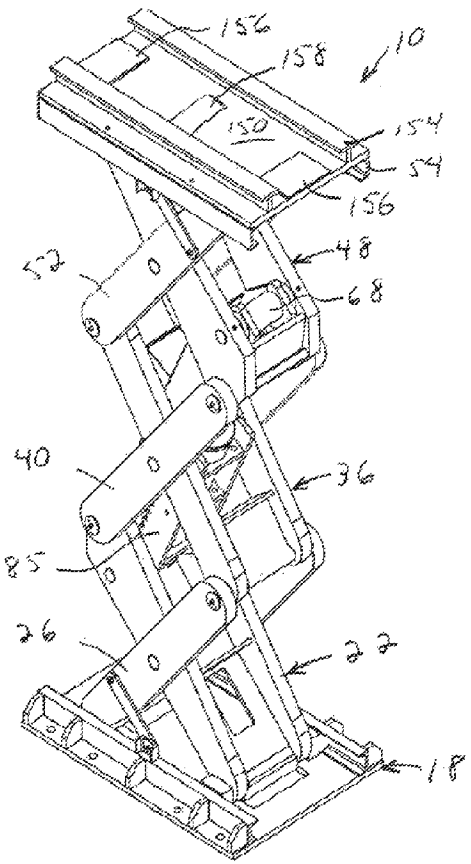
FIGS. 5A-5C are front (or rear), side, and perspective views, respectively, of the lifting device shown in FIGS. 1-4, depicting the lifting device in its extended position.
Figure 5B:
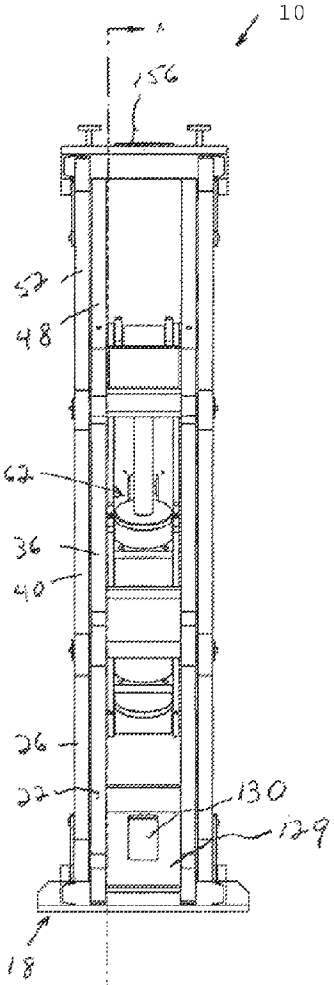
Figure 5A:
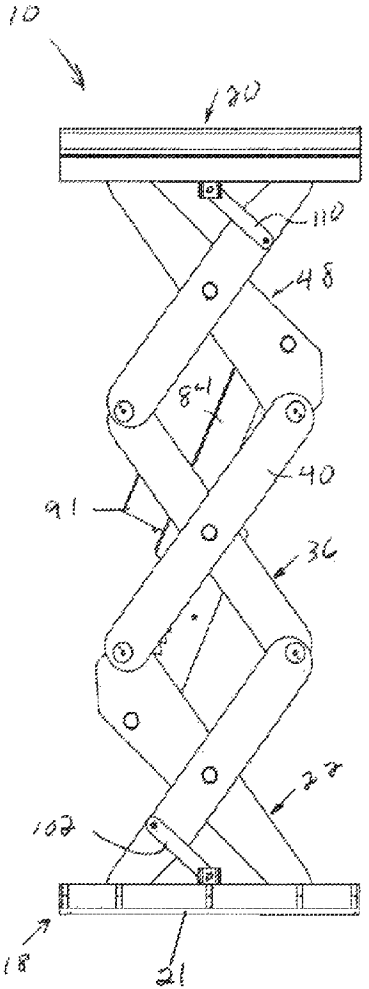
Figure 5D:
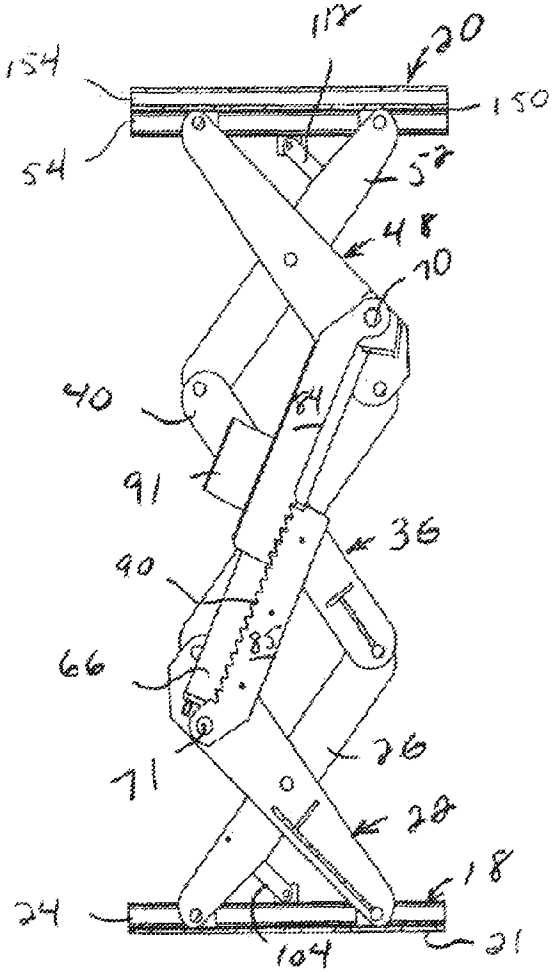
FIG. 5D is a cross-sectional view of the lifting device shown in FIGS. 1-5C, taken through the line "A-A" of FIG. 5B.
Figure 6:
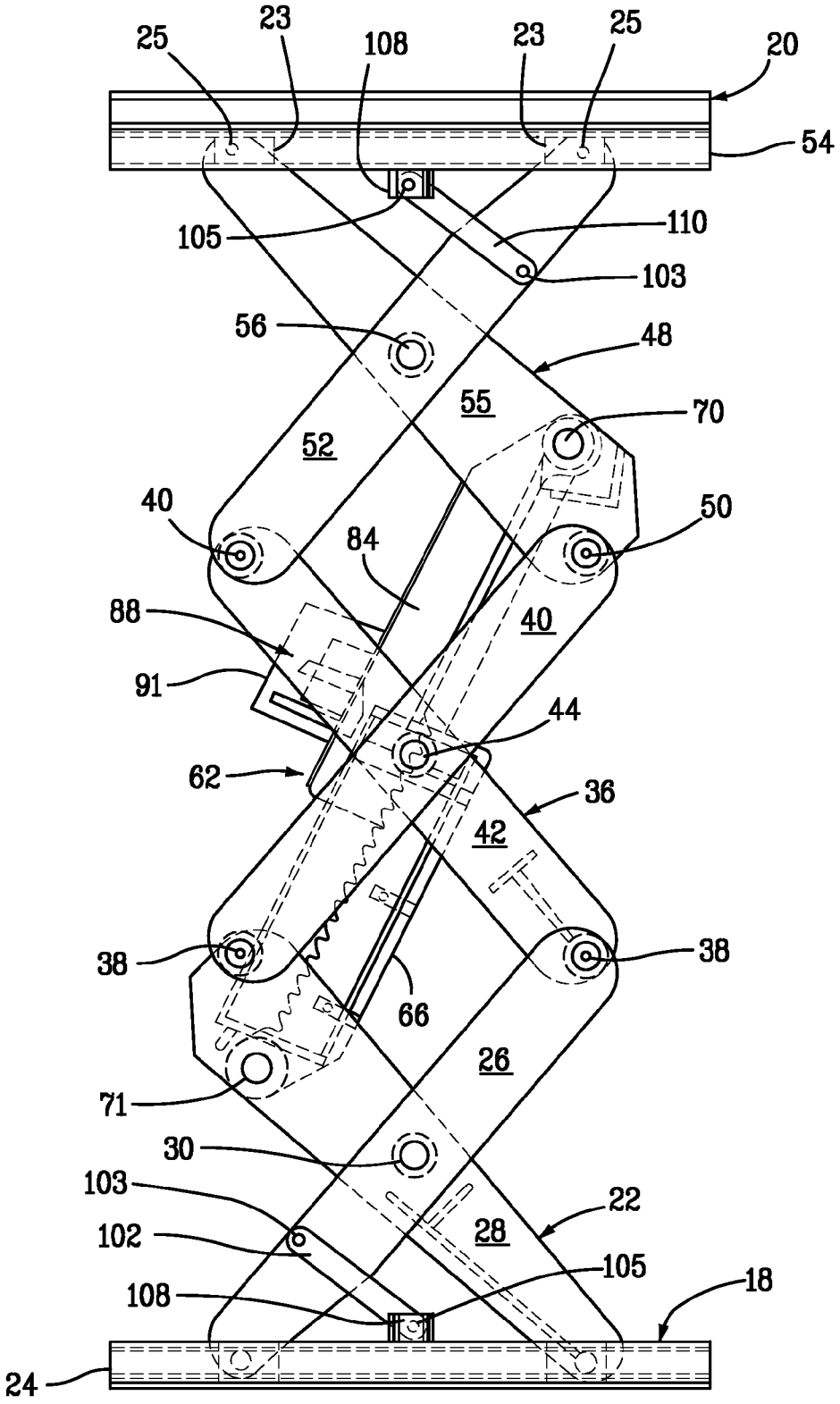
FIG. 6 is a front (or rear) view of the lifting device shown in FIGS. 1-5D, depicting the lifting device in its extended position.

A second end of each leg 55 of the weldment 48 is pivotally coupled to the bolster 20 by another pair of the slider blocks 23, and a pin 51 secured to the legs 55 (see FIGS. 1, 5C, and 6). Preferably, the pin 51 is secured to each of the legs 55 by welds formed between the pin 51, and both the inwardly and outwardly facing sides of each leg 55. Each slider block 23 is located within a corresponding one of the channels 54 of the bolster 20, and slides within the channel 54 as the device 10 moves between its extended and retracted positions.

A second end of each outer leg leaf 52 is pivotally coupled to the bolster 20 by another pair of the slider blocks 23 each disposed within an associated one of the channels 54, and another of the pins 25. The slider blocks 23 slide within their associated channel 54 as the device 10 moves between its extended and retracted positions.

Another pair of the sleeves 31 preferably is disposed on both the pin 51, and the pin 25 associated with the outer leg leaves 52. The sleeves 31 contact the base plate 150 of the bolster 20, and thereby increase the load-bearing area on the pins 51, 25.

One of the outer leg leaves 52 is pivotally coupled to a leg 55 of the inner leg weldment 48 by a suitable means such as a pin 56 attached to the leg 55, and another journal bearing 134 and washer 136. The pin 56 and the journal bearing 134 preferably are accommodated by a counterbore formed in the leg 55. The pin 56 is preferably positioned proximate a mid-point of the leg 55, and engages the outer leg leaf 52 by way of a hole 58 formed in the outer leg leaf 52 proximate a mid-point thereof. The other of the outer leg leaves 52 is pivotally coupled to another leg 55 of the inner leg weldment 48 in a similar manner.

The pins 25, 30, 38, 39, 42, 49, 51, 55, 125 can be formed from 4140 casehardened steel, or other suitable materials. The pins 25, 30, 38, 39, 42, 49, 51, 55, 125 can each have a diameter of approximately two Inches. It should be noted that the optimal diameter for these pins is application-dependent, and can vary with factors such as the maximum lifting capacity of the device 10. A specific value for the diameter is presented for exemplary purposes only.

The lifting device 10 is depicted with three tiers for exemplary purposes only. The optimal number of tiers is application dependent, and can vary with factors such as the desired lifting capacity of the lifting device 10, and the desired height of the lifting device 10 above the shop floor when the lifting device 10 is in its extended position.

The hydraulic actuator 62 actuates the lifting device 10 between its extended and retracted positions (see FIGS. 2, 4, 5B, 5C, and 14). The hydraulic actuator 62 includes a cylinder 66, and a rod 68 that retracts and extends into and out of the cylinder 66. An end of the rod 68 is pivotally coupled to the legs 55 of the weldment 48, proximate the first end of the weldment 48, by a suitable means such as a pin 70. The pin 70 can be formed, for example, from heat-treated 4140 steel or other suitable materials. The pin 70 can be equipped with drilled and tapped holes to accommodate a slide puller during disassembly of the device 10.

Figure 14:
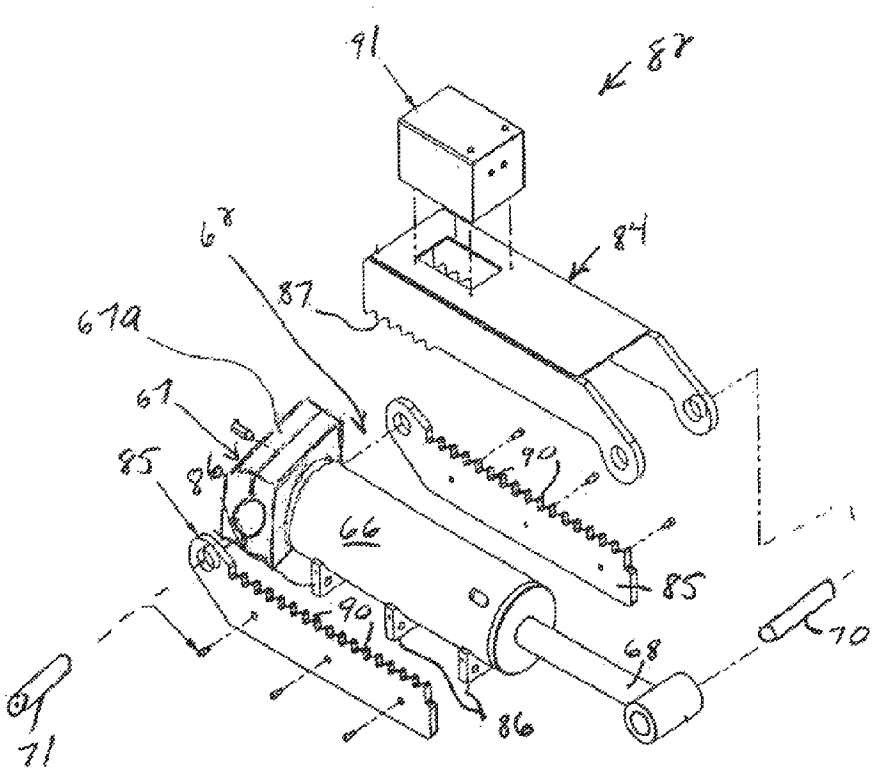
FIG. 14 is an exploded perspective view of the locking mechanism shown in FIG. 13.
Figure 13:
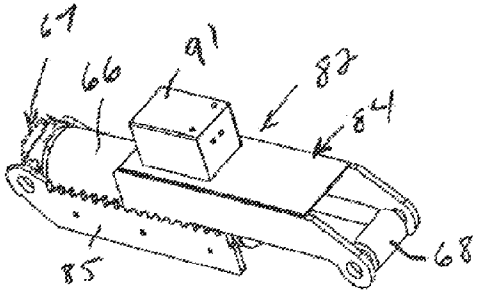
FIG. 13 is a perspective view of a locking mechanism of the lifting device shown in FIGS. 1-12, with an upper lock assembly of the locking mechanism in a locked position.

An end of the cylinder 66 is pivotally coupled to the legs 28 of the weldment 22, proximate the first end of the weldment 22, by a suitable means such as a pin 71. The cylinder 66 can include a pin-retaining member 67 for receiving the pin 71 (see FIG. 14). The member 67 can be split, as depicted in FIG. 14, so that a first half 67*a* of the member 67 can be removed from the remainder of the cylinder 66. The first half 67*a* can be secured to the remainder of the member 67 by four bolts (not shown). This feature can facilitate removal and installation of the cylinder 66 without need to disassemble or otherwise remove any of the components of the first tier of the device 10.

It should be noted that other types of actuators can be used in lieu of the hydraulic actuator 62 in alternative embodiments.

The pin 71 can be accommodated by through holes formed in the legs 28 of the inner leg weldment 22 (see FIG. 8). Bolts 73 can be used to secure the pin 71 from rotational and axial movement in relation to the legs 28. The bolts 73 can extend upward through taps 75 formed in the legs 28, and can threadably engage an upper portion (not shown) of the corresponding tap 75, i.e., a portion of the tap 75 located above the corresponding through hole.

The weldment 22 includes mounting plates 72, and a gusset 74 secured to. An inwardly-facing surface of each leg 55 thereof (see FIGS. 10 and 11). The mounting plates 72 and the gusset 74 provide the weldment 48 with additional strength to withstand the loads that the hydraulic actuator 62 exerts thereon.

The cylinder 66 preferably is a double-acting cylinder. The cylinder 66 is in fluid communication, on a selective basis, with a tank of hydraulic fluid located within a free-standing control console (not shown). The hydraulic fluid is pressurized by a pump (not shown), and acts on a piston (not shown) within the cylinder 66 so as to cause the piston to translate within the cylinder 66. Movement of the piston imparts a corresponding movement to the rod 68 that causes the rod 68 to extend from or retract into the cylinder 66. The flow of hydraulic fluid to the cylinder 66 (and the resulting movement of the rod 68) is controlled by way of the control console.

The control console can also include, for example, a hydraulic pump, a hydraulic manifold and valving, a starter motor, thermal overloads, a programmable logic controller, and operator interface push buttons.

The piston of the hydraulic actuator 62 preferably has a stroke of approximately twenty-one inches, and the cylinder 66 preferably has a bore of approximately seven inches. The hydraulic fluid is preferably supplied to the hydraulic actuator 62 at a pressure of approximately 3,500 psi when the lifting device 10 is being extended, and at a pressure of approximately 500 psi when the lifting device 10 is being retracted. The hydraulic actuator 62 requires approximately 3.5 gallons of hydraulic fluid. It should be noted that the stroke, bore, operating pressures, and fluid capacity associated with the hydraulic actuator 62 are application dependent; specific values for these parameters are specified for exemplary purposes only.

The cylinder 66 preferably has a wall thickness of approximately ½-inch. The optimal value for the wall thickness is application-dependent, and can vary with factors such as the maximum lifting capacity of the device 10. A specific value for the wall thickness is presented for exemplary purposes only.

Retraction and extension of the rod 68 into and out of the cylinder 66 imparts forces on the weldment 22 and the weldment 48. These forces cause the lifting device 10 to move between its retracted and extended positions.

The lifting device 10 further includes a locking mechanism 82 for locking the lifting device 10 in its extended position, or in a partially-extended position (see FIGS. 3D, 5D, 13, and 14). The locking mechanism 82 includes an upper lock assembly 84, and two jaw locks 85. The upper lock assembly 84 and the jaw locks 85 can be formed from A514 (T1) high strength steel, or other suitable materials. The jaw locks 85 are secured to mounting provisions 86 formed on the cylinder 66. An end of each jaw lock 85 is pivotally coupled to the first end of the weldment 22 by the pin 71 (the jaw locks 85 therefore pivot with the cylinder 66).

The upper lock assembly 84 is pivotally coupled to the legs 55 of the weldment 48 by the pin 70. The upper lock assembly 84 has a plurality of teeth 87 formed therein, and the jaw locks 85 each have a plurality of teeth 90 formed therein. The upper lock assembly 84 can pivot between a locked position (FIG. 5D) in which the teeth 87 engage the teeth 90, and an unlocked position (FIG. 3D) where the teeth 87 are disengaged from the teeth 90.

The locking mechanism 82 prevents the lifting device 10 from moving toward its retracted position when the teeth 87 engage the teeth 90 (the lifting device 10 can move toward its retracted position when the teeth 87 and the teeth 90 are disengaged). The teeth 87 can ride over the teeth 90 as the lifting device 10 moves toward its extended position. In other words, the engagement of the teeth 87 and the teeth 90 does not prohibit extension of the lifting device 10.

The configuration of the upper lock assembly 84 and the jaw locks 85 permits the lifting device 10 to be locked in various positions (including its fully-extend position, and a position approximately twenty-four inches above the floor as required by the Automated Lift Institute and ANSI standard, ALCTV 1998).

Figure 15:
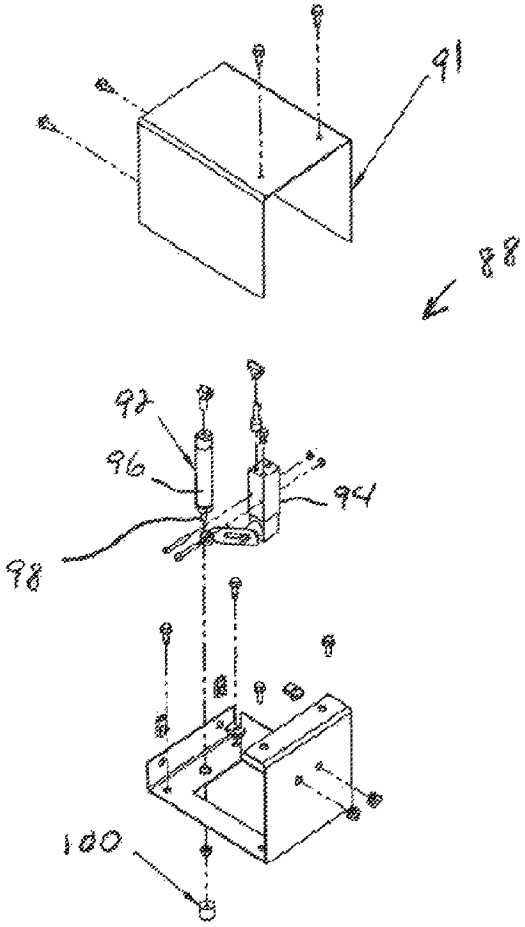
FIG. 15 is an exploded perspective view of a lock actuator and control assembly of the locking mechanism shown in FIGS. 13 and 14.
Figure 16:
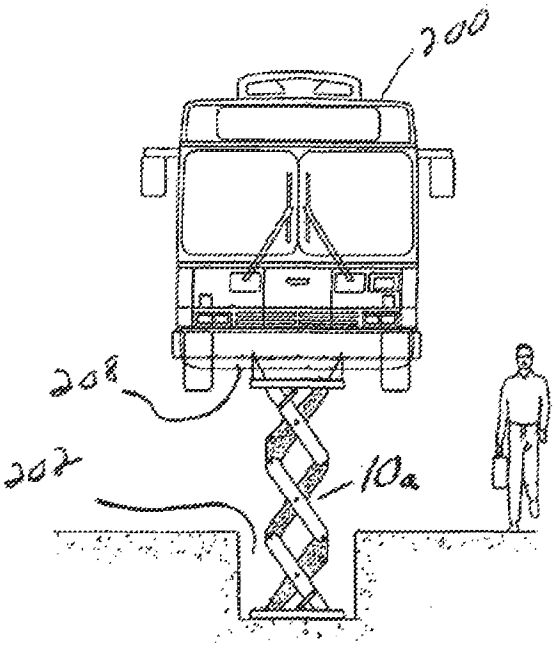
FIG. 16 is a front view of an installation incorporating two of the lifting devices shown in FIGS. 1-15, depicting one of the lifting devices in a front pit, with the lifting device in its extended position and lifting a bus.

The locking mechanism 82 also includes a lock actuator and control assembly 88 mounted on the upper lock assembly 84, within a housing 91 (see FIG. 15). The lock actuator and control assembly 88 causes the upper lock assembly 84 to pivot between its locked and unlocked positions. The lock actuator and control assembly 84 preferably comprises a pneumatic actuator 92 and a pneumatic limit switch 94. The pneumatic actuator 92 comprises a cylinder 96 secured to the housing 91. The pneumatic actuator 92 also comprises a shaft 98 that extends from and retracts into the cylinder 96.

The pneumatic actuator 92 is in fluid communication with a source of pressurized air (not shown) on a selective basis. The flow of pressurized air to the pneumatic actuator 92 causes the shaft 98 to extend from the cylinder 96. Extension of the shaft 98 causes the shaft 98 to contact and exert a force on the cylinder 66 of the hydraulic actuator 62 by way of a bumper 100. Further extension of the shaft 98 causes the shaft 98 to lift the upper lock assembly 84 toward its unlocked position (interrupting the flow of pressurized air to the pneumatic actuator 92 causes the shaft 98 to retract into the cylinder 96, thereby causing the upper Jock assembly 84 to return to its locked position).

The flow of pressurized air to the pneumatic actuator 92 is controlled from the control console. The pneumatic limit switch 94 contacts the cylinder 66 of the hydraulic actuator 62 so that the pneumatic limit switch 94 receives a mechanical input indicating the position of the pneumatic actuator 92 (and the upper lock assembly 84). The pneumatic limit switch 94 sends a pneumatic signal to the control console indicating the position of the upper Jock assembly 84.

The lifting device 10 preferably comprises a centering mechanism. The centering mechanism causes the lifting device 10 to extend and retract in a substantially vertical direction, without substantial movement in the lateral direction. In other words, the centering mechanism causes the bolster 20 to remain substantially centered in relation to the base 18 as the lifting device 10 moves between its retracted and extended positions. The feature causes the load on the lifting device 10 to remain substantially centered on the lifting device 10, and can thereby enhance the stability of the lifting device 10.

The centering mechanism comprises a first centering link 102 and a second centering link 104 (see FIGS. 1 and 2). An end of the first centering link 102 is pivotally coupled to one of the outer leg leaves 26, between the mid-point and the first end thereof, by a ½-inch diameter bolt 105 (see FIG. 12). It should be noted that the optimal diameter of the bolt 105 is application-dependent, and can vary with factors such as the maximum lifting capacity of the device 10. A specific value for this parameter is disclosed for exemplary purposes only.

The other end of the first centering link 102 is pivotally coupled to a mounting provision 108 formed on the base 18, by way of a pin 103. An end of the second centering link 104 is pivotally coupled to the other of the outer leg leaves 26, between the mid-point and the first end thereof, by another bolt 105. The other end of the second centering link 104 is pivotally coupled to another of the mounting provisions 108 formed on the base 18, by another bolt pin 103.

Figure 12:
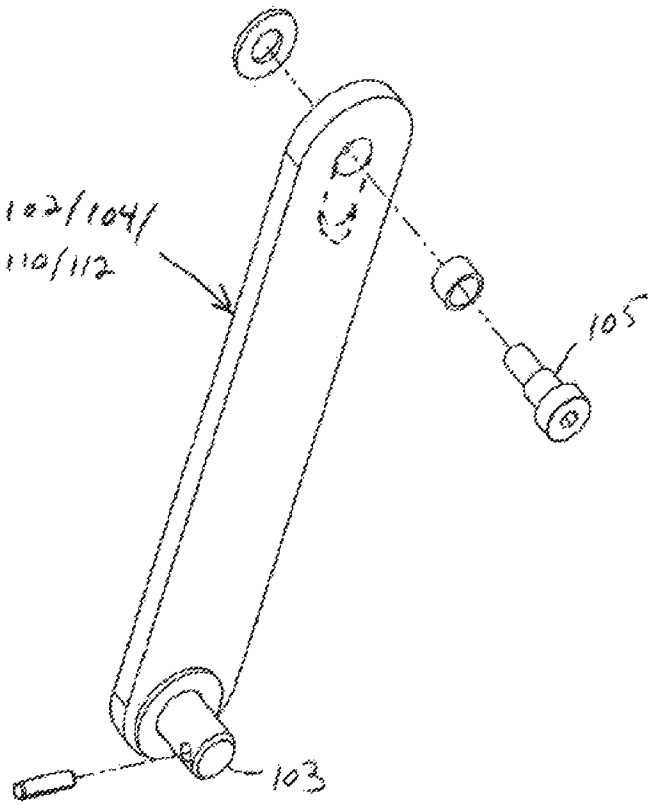
FIG. 12 is a perspective view of a centering link of the lifting device shown in FIGS. 1-11.
Figure 11:
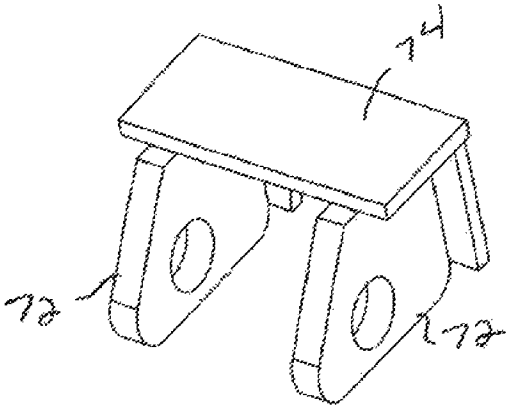
FIG. 11 is a perspective view of reinforcing plates and a gusset of the inner leg weldment shown in FIG. 10.

The bolt 105 that joins the first centering link 102 and the associated outer leg leaf 26 preferably is accommodated by a slot formed in the first centering link 102 (the slot is shown in phantom in FIG. 12). The other bolts 105 preferably are accommodated by substantially circular holes the second centering link 104. The use of the slot in the first centering link 102 can-help to facilitate insertion of the associated bolt 105 in the first leg leaf 26, when the first leg leaf 26 and the first centering link 102 are misaligned due to the stack-up of manufacturing tolerances of the various components of the device 10.

The centering mechanism further comprises a third centering link 110 and a fourth centering link 112. An end of the third centering link 110 is pivotally coupled to one of the outer leg leaves 52 of the third tier 16, between the mid-point and the first end thereof, by another bolt 105. The other end of the third centering link 110 is pivotally coupled to a mounting provision 114 formed on the bolster 20, between the mid-point and the first end thereof, by another pin 103. An end of the fourth centering link 112 is pivotally coupled to the other of the outer leg leaves 52 of the third tier 16, by another bolt 105. The other end of the fourth centering link 112 is pivotally coupled to another of the mounting provisions 114 formed on the bolster 20, by another pin 103.

The bolt 105 that joins the third centering link 110 and the associated outer leg leaf 26 preferably is accommodated by a slot formed in the third centering link 110. The other bolt 105 preferably is accommodated by a substantially circular hole formed in the fourth centering link 112.

The bolster 20, as noted above, accommodates the mating assembly 170 that acts as an interface between the device 10, and the bus 200 or other vehicle being lifted by the device 10. The mating assembly 170 preferably comprises two base adapters 172, a plurality of extensions, or risers 173, and a plurality of accessory adapters 174 (see FIGS. 29-33).

The accessory adapters 174 engage the axle of the bus 200 or other vehicle being lifted by the device 10. The base adapters 172 mate with the bolster 20, and permit the mating assembly 170 to be positioned at a desired location on the bolster 20. The risers 173 allow the height of the accessory adapters 174 in relation to the accessory adapters to be adjusted to accommodate a particular type of vehicle.

Figure 31:
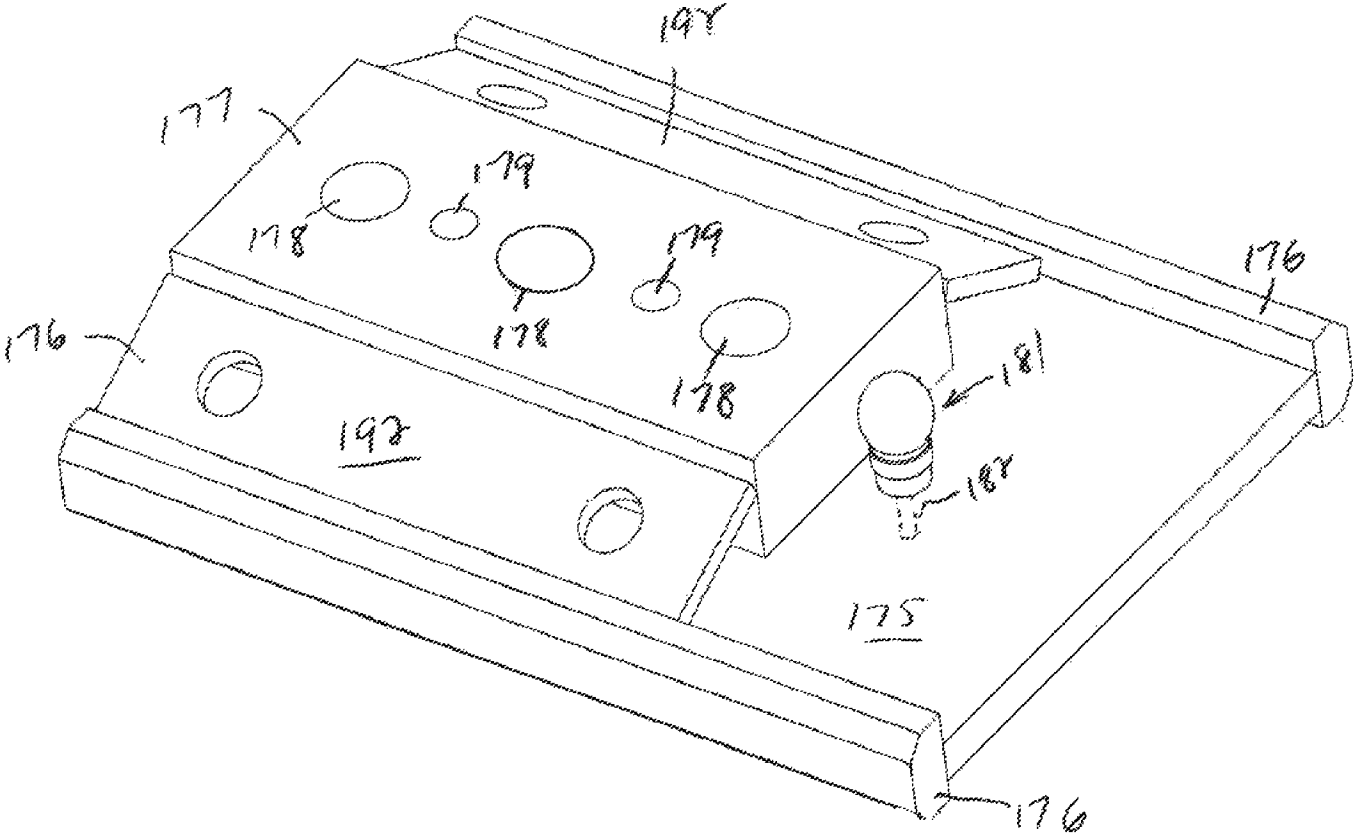
FIG. 31 is a perspective view of a base adapter of the mating assembly shown in FIGS. 29 and 30.
Figure 32:
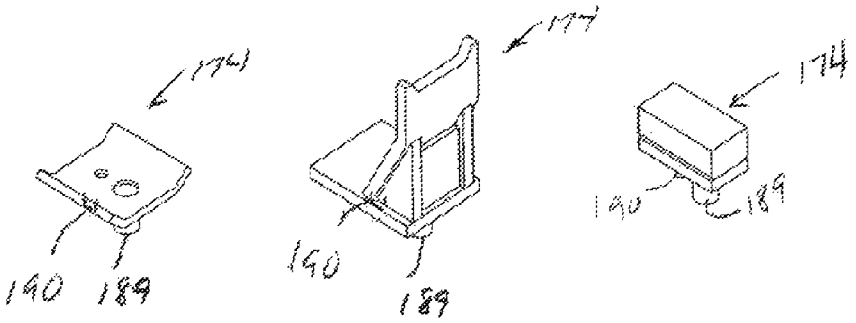
FIG. 32 includes perspective views of various risers of the mating assembly shown in FIGS. 29-31.

The base adapters 172 each comprise a plate member 175, and two guides 176 secured to opposite sides of the plate member 175 (see FIG. 31). The guides 176 preferably are shaped to fit within one of the T-shaped members 154 of the bolster 20, as shown in FIGS. 31 and 32. Each base adapter 172 also comprises a mating block 177 secured to the plate member 175 by a suitable means such as welding.

Three relatively large diameter holes 178, and two relatively small diameter holes 179 are formed in the mating block 177. The large and small diameter holes 178, 179 are positioned so that each small diameter hole 179 is located between two large diameter holes 178.

Each base adapter 172 also comprises two reinforcing plates 192 positioned between, and secured to the mating block 170 and an associated guide 176, and a pin assembly 181. The pin assembly 181 is biased in a downward direction by a suitable means such as a spring. Contact between a pin 182 of the pin assembly 181 and an associated one of the retaining plates 156 on the base plate 150 of the bolster 20 prevents the base adapter 172 from moving outward and disengaging from the bolster 20. Inward movement of the base adapter is limited by contact between the pin 182 and the stop 158 on the base plate 150.

The base adapter 172 can be removed from the bolster 20, if desired, by pulling the pin assembly 181 upward, so that the pin 182 can clear the associated retaining plate 156, and pulling the base adapter 172 outward.

The risers 173 allow the height of the accessory adapters 174 in relation to the accessory adapters to be adjusted to accommodate a particular type of vehicle, as noted above. The risers 173 can have respective heights of, for example, three, six, and seven inches (see FIG. 32). Each riser 173 preferably includes a relatively large diameter projection 183 and a relatively small diameter projection 184 that each extend from a lower surface of the riser 173. The large and small diameter projections 183, 184 are configured to engage the base adapters 172 by way of the large and small diameter holes 178, 179 formed therein. The arrangement of the large and small diameter holes 178, 179 allows the risers 173 to be placed in one of four different positions along the length of the associated accessory adapter 174.

Each riser 173 has a relatively large diameter hole 185, and a relatively small diameter hole 186 formed therein. The large and small diameter holes 185, 186 extend inward from an upper surface of the riser 173.

Figure 33:
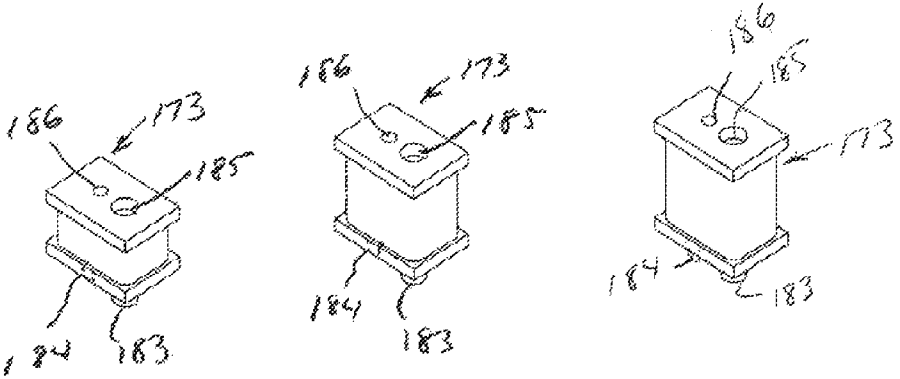
FIG. 33 includes perspective views of various accessory adapters of the mating assembly shown in FIGS. 29-32.
Figure 34C:
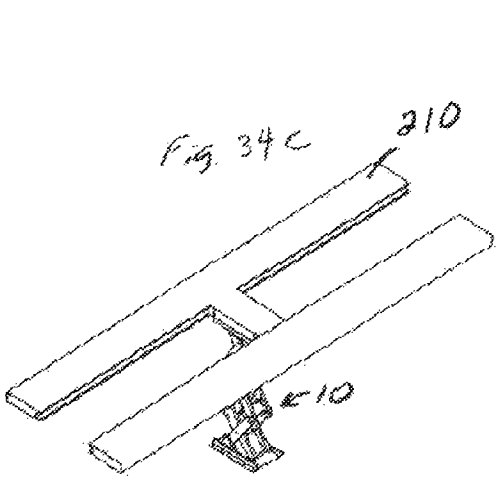
FIGS. 34A-F depict a lifting device of the type shown in FIGS. 1-6, configured for use with a platform for accommodating a vehicle.
Figure 34F:
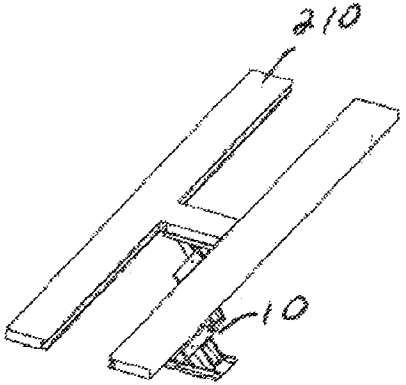
Figure 34B:
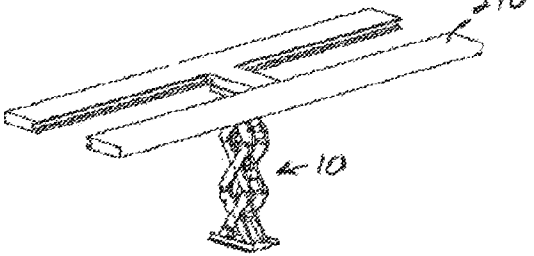
Figure 34E:
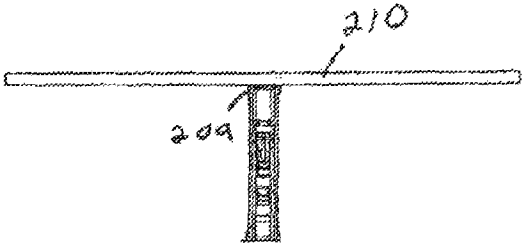
Figure 34A:
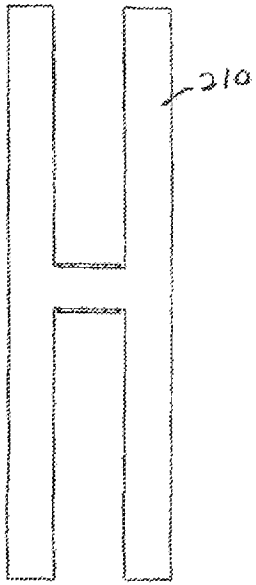
Figure 34D:
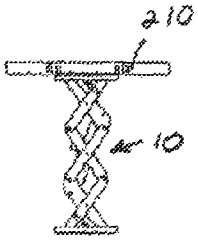
Figure 35A:
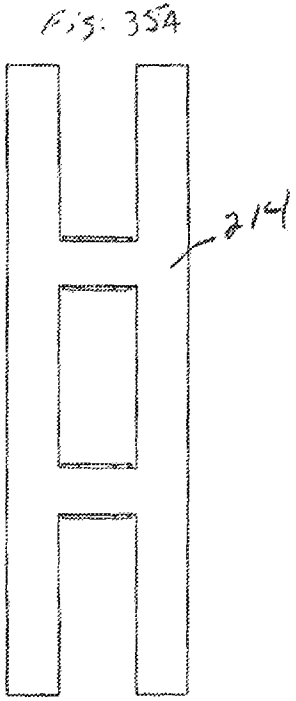
FIGS. 35A-D depict two lifting devices of the type shown in FIGS. 1-6, configured for use with another type of platform for accommodating a vehicle.
Figure 35B:
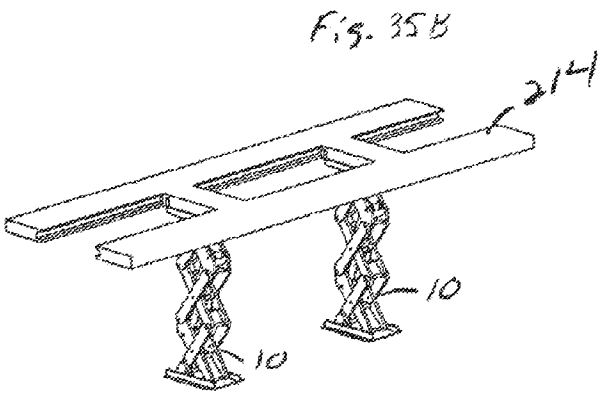
Figure 35C:
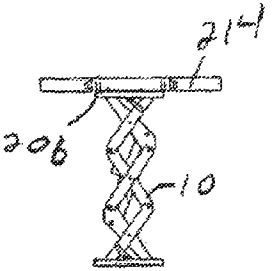
Figure 35D:
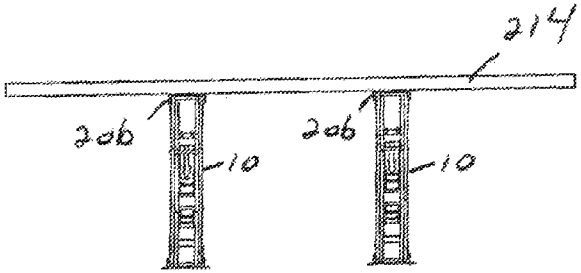
Figure 36B:
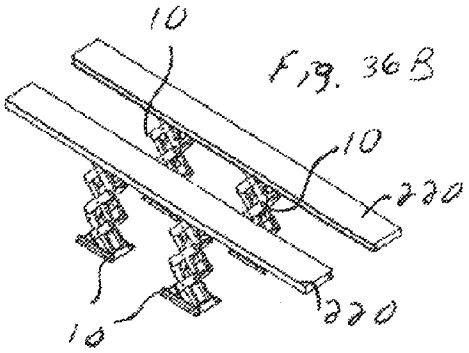
FIGS. 36A-F depict four lifting devices of the type shown in FIGS. 1-6, configured for use with another type of platform for accommodating a vehicle.
Figure 36D:
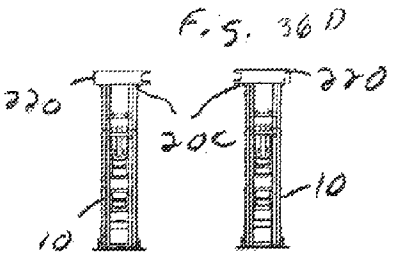
Figure 36F:
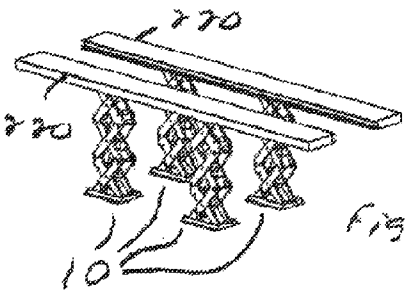
Figure 36A:
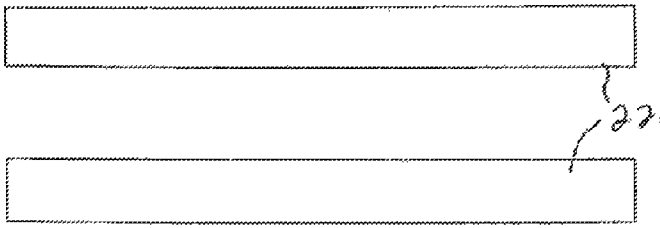
Figure 36C:
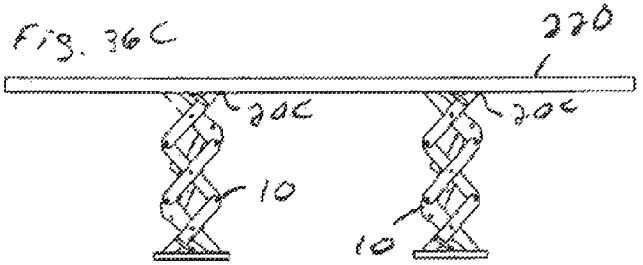
Figure 36E:
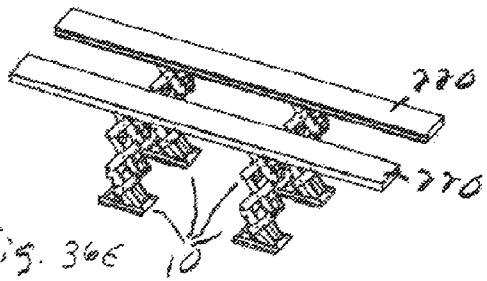
Figure 37B:
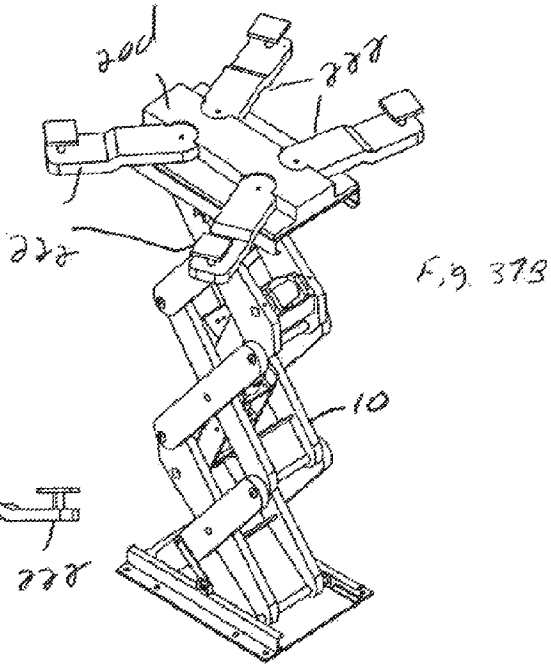
FIGS. 37A-D depict a lifting device of the type shown in FIGS. 1-6, configured for use with swing arms for accommodating a vehicle.
Figure 37D:
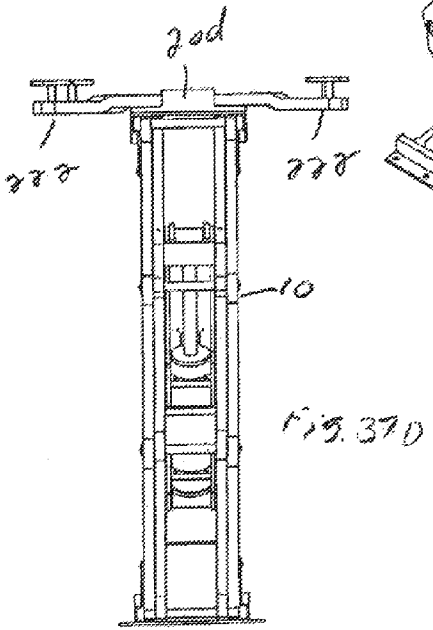
Figure 37A:
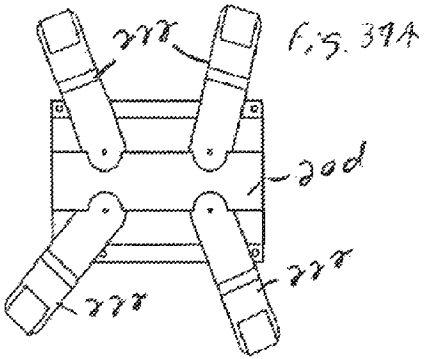
Figure 37C:
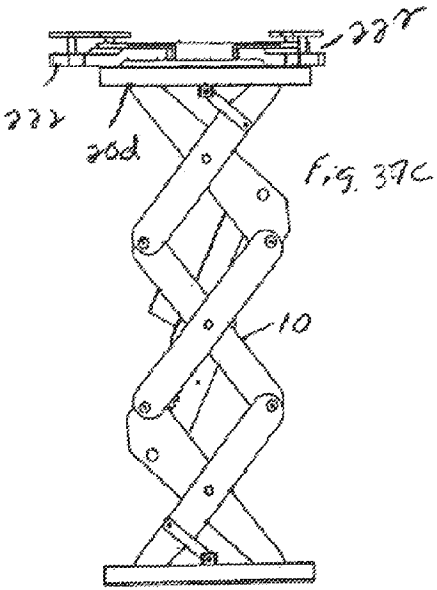
Figure 38A:
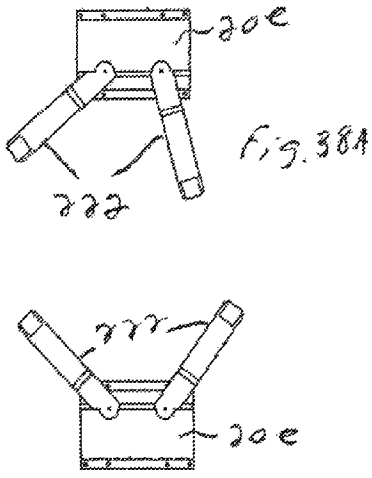
FIGS. 38A-D depict two lifting devices of the type shown in FIGS. 1-6, configured for use with swing arms for accommodating a vehicle.
Figure 38B:
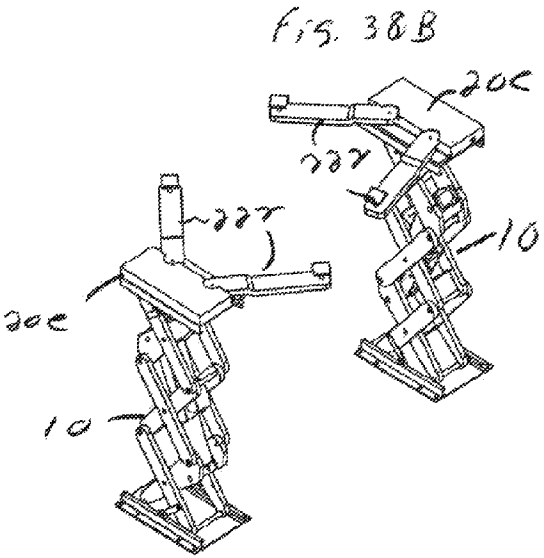
Figure 38C:
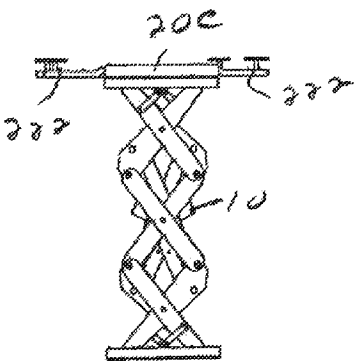
Figure 38D:
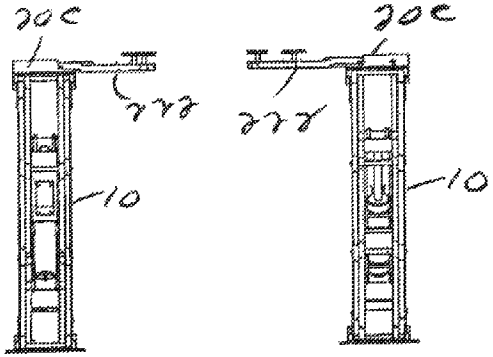

The accessory adapters 174 are configured to engage different types of axles, to facilitate use of the device 10 with different types of vehicles (see FIG. 33). Each accessory adapter 174 has a relatively large diameter projection 189, and a relatively small diameter projection 190 formed thereon, and extending from a lower surface thereof. The large and small diameter projections 189, 190 are sized to engage the risers 173 by way of the large and small diameter holes 185, 186 formed therein.

The size and relative locations of the large and small diameter projections 189, 190 on the accessory adapters 174 are substantially identical to the size and relative locations of the large and small diameter projections 183, 184 on the risers 173. The accessory adapters 173 therefore can be used without the risers 173, i.e., the accessory adapters 173 can be mounted directly on the base adapters 172.

The ability to position the risers 174 or the accessory adapters 173 in four different positions on the base adapters 172, and the ability to vary the position of the base adapters 172 in relation of the bolster 20 can provide the user with substantial flexibility in positioning the accessory adapters 174 at a suitable location on the axle of the vehicle being lifted. For example, the spacing between the outer ends of the accessory adapters 174 can be varied between a minimum of approximately 24½ inches, and a maximum of approximately 55½ inches (as shown in FIG. 31). (The maximum and minimum spacing can vary by application; specific values are presented for exemplary purposes only).

FIGS. 16-18 depict an exemplary installation for the lifting device 10. In particular, FIGS. 16-18 show two of the lifting devices (the forward-located lifting device is designated 10*a*, and the rearward-located lifting device is designated 10*b*; the lifting devices 10*a*, 10*b* are substantially identical to the lifting device 10).

The lifting device 10*a* is located in a front pit 202, and is movable in the forward or rearward directions, i.e., to the left and right from the perspective of FIG. 18. The lifting device 10*b* is positioned in a rear pit 204, and is fixed, i.e., the lifting device 10*b* cannot move in the forward and rearward directions.

The bus 200 has a front axle 208 and a rear axle 210. The lifting devices 10*a*, 10*b* lift the bus 200 (or other vehicle) by the front and rear axles 208, 210. In particular, the bus 200 can be driven over the lifting devices 10*a*, 10*b* so that the rear axle 210 is positioned directly over the lifting device 10*b*. The position of the lifting device 10*a* can subsequently be adjusted so that the lifting device 10*a* is positioned directly below the front axle 208. The lifting devices 10*a*, 10*b* can then be extended so that the mating assembly 170 of each lifting device 10*a*, 10*b* contact the respective front and rear axles 208, 210 and lift the bus 200. (Extension of the lifting devices 10*a*, 10*b* can be commanded from the control console, as discussed above with respect to the lifting device 10; the hydraulic lines that supply pressurized hydraulic fluid to the hydraulic actuator 62 of each lifting device 10*a*, 10*b* are not depicted in FIGS. 16-18, for clarity).

Lifting the bus 200 by the front and rear axles 208, 210 is particularly well suited for maintenance or repair operations in which or more of the wheels of the bus 200 must be removed, as lifting the bus 200 by the front and rear axles 208, 210 is believed to minimize the height by which the body of bus 200 must be lifted to break contact between the wheels and the shop floor. Moreover, lifting the bus 200 by the axles 208, 210, it is believed, minimizes the obstacles and obstructions presented by the lifting equipment to a mechanic or other individual working beneath the bus 200, in comparison to other lifting methodologies.

The lifting device 10*a* is preferably positioned in a carriage 300 (see FIGS. 23, 24, 26, and 27. The carriage 300 is suspended within a pit box, or support structure 234 installed in the front pit 202 (see FIG. 23). The carriage 300 facilitates movement of the lifting device 10*a* within the support structure 234 in the forward and rearward directions, so that the lifting device 10*a* can be aligned with the front axle 208 of the bus 200. A cover 232 is installed on the support structure 234, and moves with the carriage 300, as explained below (the cover 232 is not shown in FIG. 23, for clarity).

Figure 23:
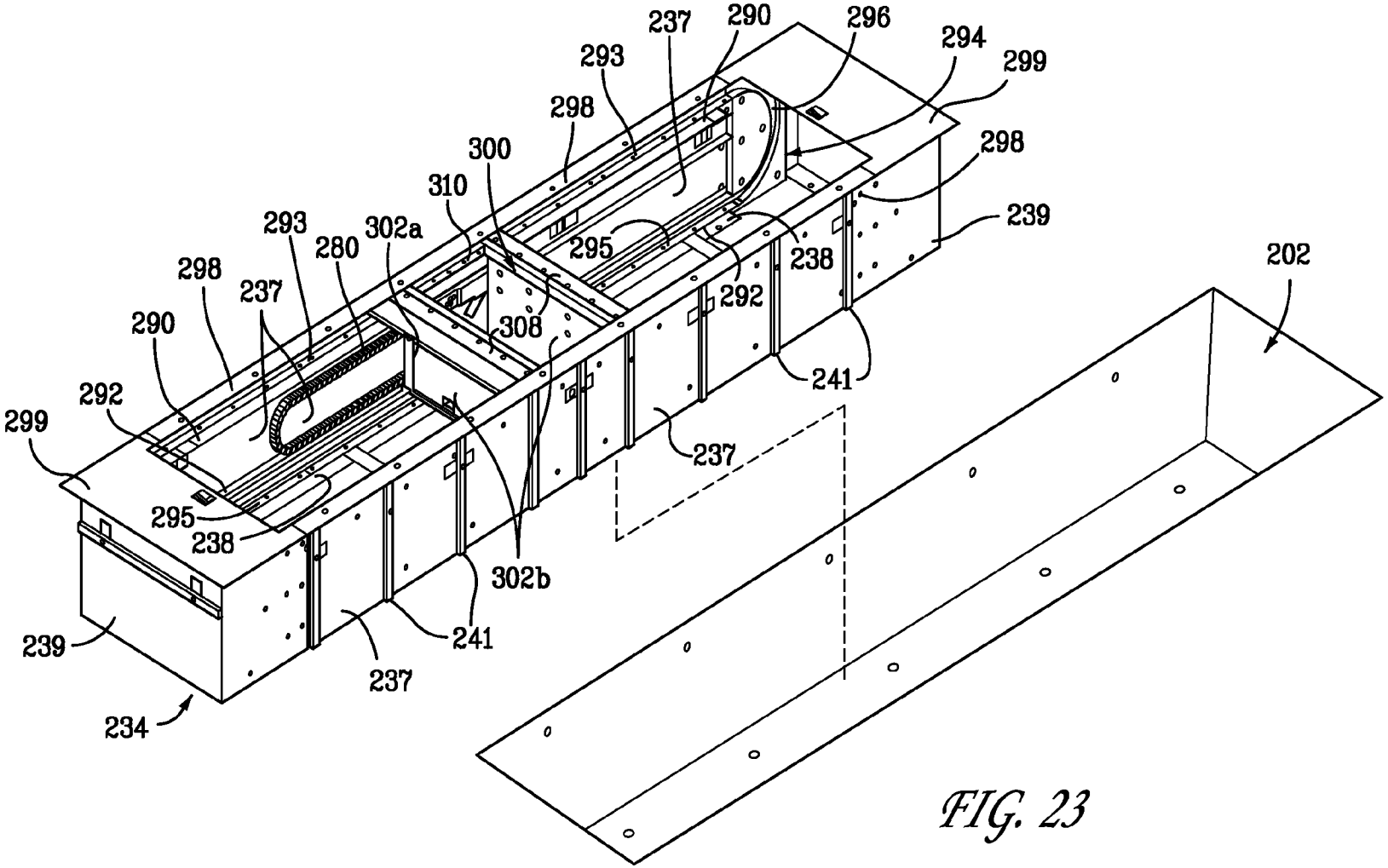
FIG. 23 is a perspective view of the front pit, lifting device, carriage, and support shown in FIGS. 16, 18, and 20, with the cover removed.

The support structure 234 preferably comprises two side panels 237, two bottom flanges 238 that adjoin a corresponding side panel 237, and two end caps 239 (see FIG. 23). The bottom flanges 238 can formed bending the sheet of material from which the associated side panel 237 is formed. The end caps 239 are secured to opposing ends of the side panels 237 and bottom flanges 238 by a suitable means such as fasteners. Each side panel 237 preferably has ribs 241 secured to an outwardly-facing surface thereof, to stiffen and strengthen the side panel 237. One of more of the side panels 237 and end caps 239 can be equipped with drain holes 291 to facilitate drainage of the support structure 234.

Figure 28:
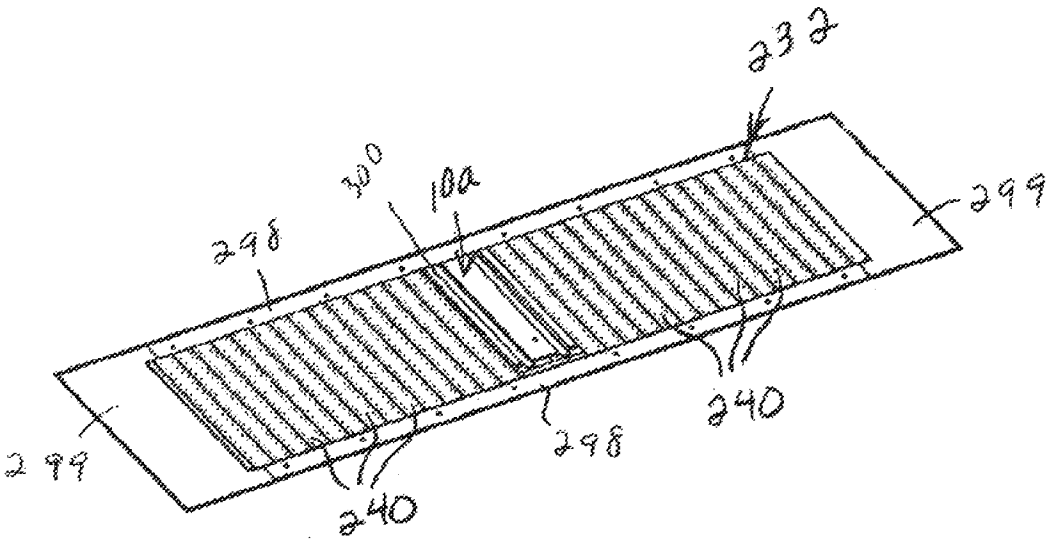
FIG. 28 is a front view of a side panel of the support structure shown in FIGS. 18, 20, and 23.

An upper support track 290 and a lower support track 292 are secured to one of the side panels 237 by a suitable means such as fasteners (see FIGS. 23 and 28). Another upper support track 290 and lower support track 292 likewise are secured to the other of the side panels 237.

A bearing strip 293 can be secured to a top surface of each of the upper and lower support tracks 290, 292. The bearing strips 293 preferably are formed from a material that helps to minimize sliding friction, such as ultra-high molecular weight polyurethane, NYLATRON, or other suitable materials.

A gear track 295 is secured to each side panel 237 below the associated upper support track 290, by a suitable means such as fasteners (see FIG. 28).

Two radius end plates 294 are secured to opposing sides of each end cap 239 by a suitable means such as fasteners (see FIG. 23). Each radius end plate 294 has a channel 296 formed therein. The channels 296 can be formed, for example, by three dimensional milling or other suitable techniques. Each channel 296 adjoins an associated upper and lower support track 290, 292. The depth of each channel 296 preferably varies along a length thereof. The significance of this feature is discussed below.

The radius end plates 294 preferably are formed from a material that helps to minimize sliding friction, such as ultra-high molecular weight polyurethane, NYLATRON, or other suitable materials.

The support structure 234 is located within the front pit 202. The support structure 234 preferably is sized so that the bottom flanges 238 rests on the bottom of the front pit 202, and minimal clearance exists between the walls of the pit 202, and the side panels 237 and end caps 239. The side panels 237, end caps 239, and bottom flanges 238 can be secured to the walls of the front pit 202 using a suitable means such as fasteners. The support structure 234 does not need to be embedded or cast in the front pit 202 using concrete and reinforcing bars, or other means. Shims can be installed between the support structure 234 and the adjacent surfaces of the front pit 202 as needed.

Figure 24:
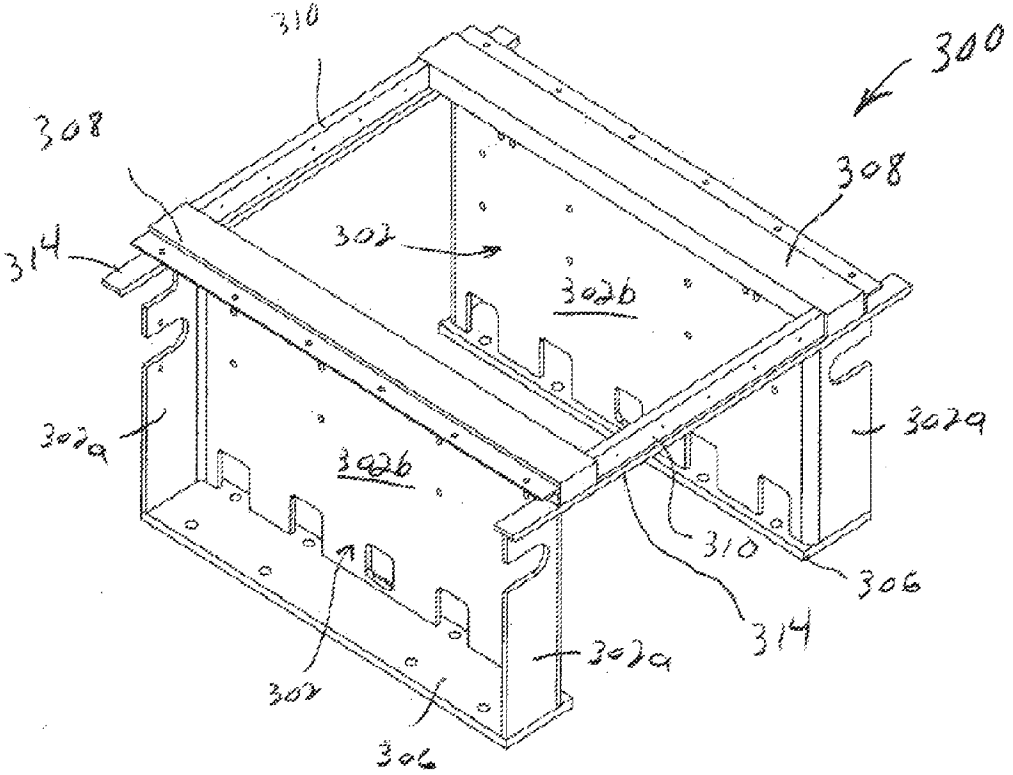
FIG. 24 is a perspective view of the carriage shown in FIGS. 18, 22, and 23.
Figure 26:
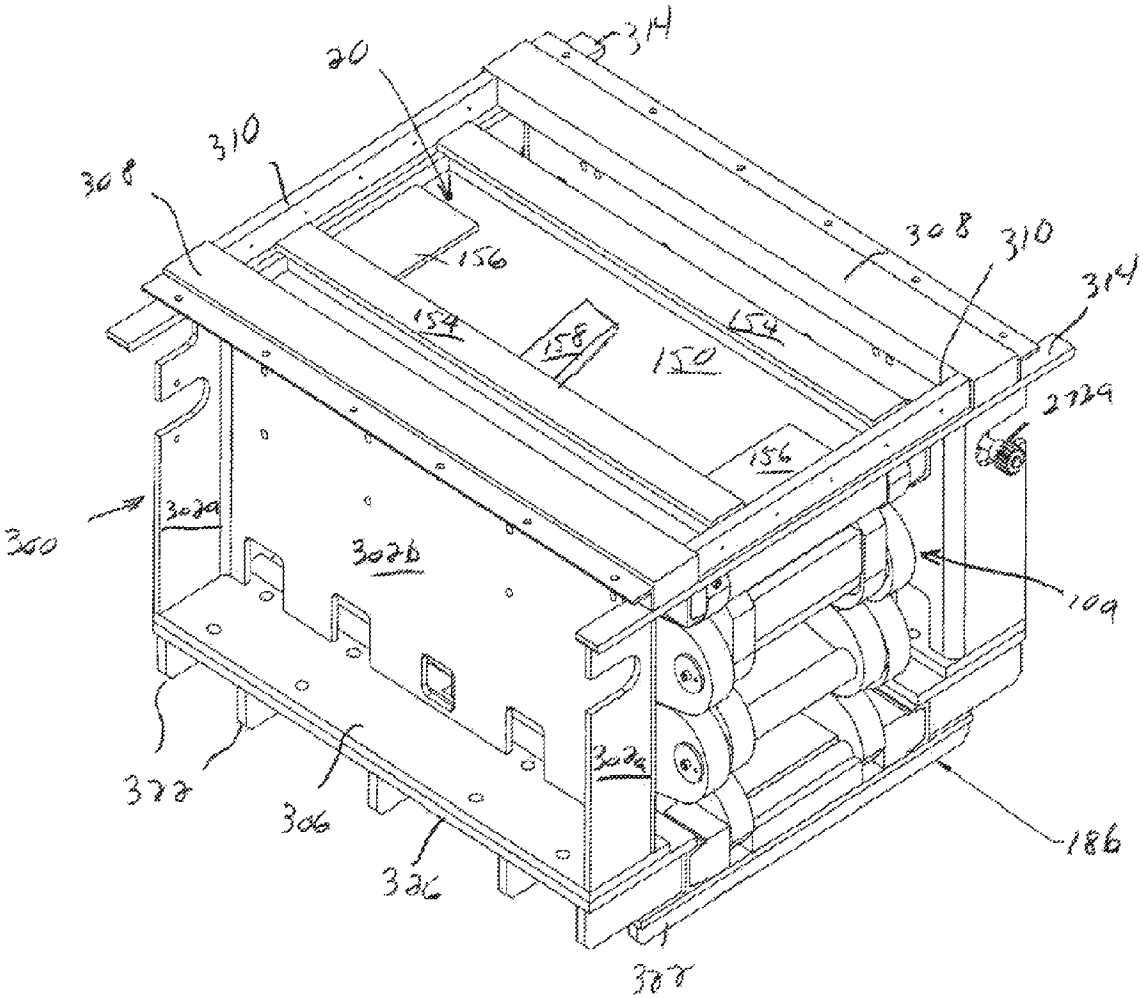
FIG. 26 is a perspective view of the lifting device, carriage, and base shown in FIGS. 16, 18, 20, and 22-25, showing the lifting device in its retracted position.
Figure 28:
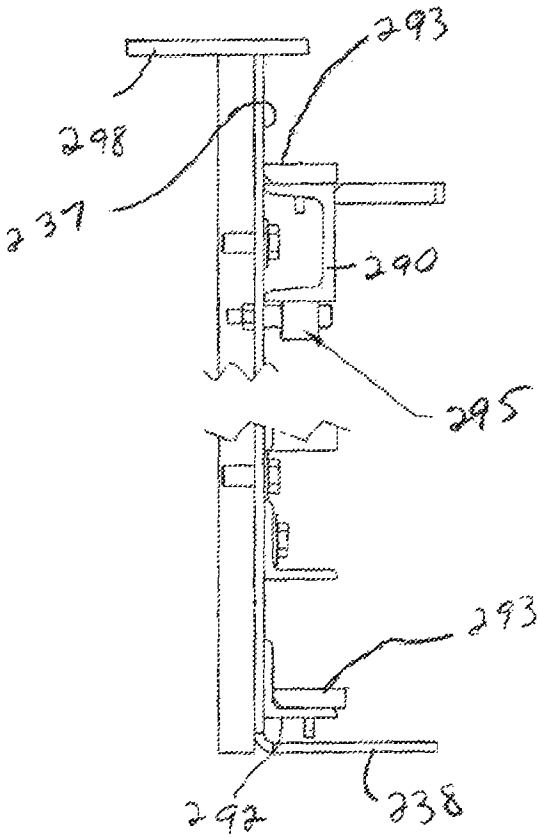
Figure 29:
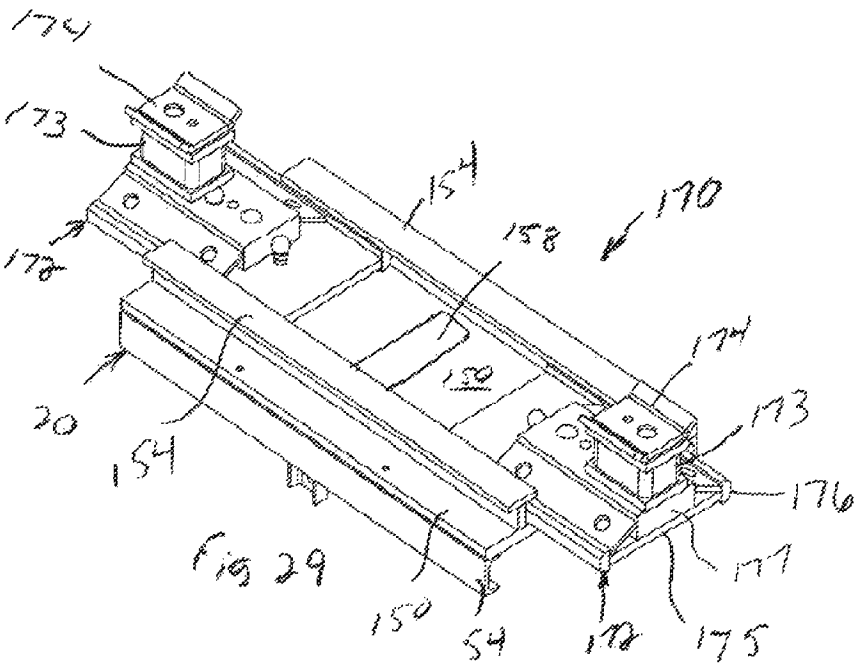
FIG. 29 is a perspective view of a mating assembly of the lifting device shown in FIGS. 1-15.
Figure 30:
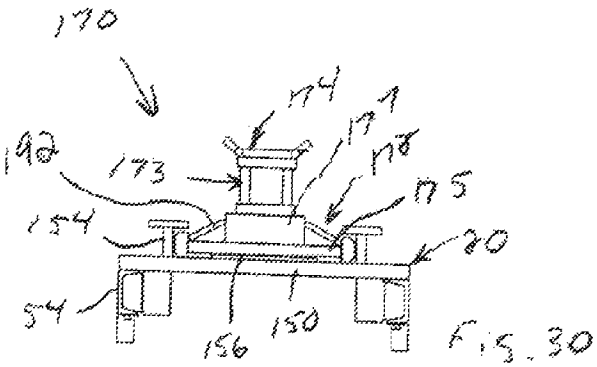
FIG. 30 is a front view of the mating assembly shown in FIG. 29.

The lifting device 10*a* is suspended within the support structure 234 by the carriage 300 (see FIGS. 24, 26, and 27). The carriage 300 comprises two side plates 302, and two lower support bars 306. Each lower support bar 306 is secured to a lower end of a corresponding one of the side plates 302 by a suitable means such as welding. Opposing ends 302*a* of each side plate 302 are bent in relation to a centrally-located portion 302*b* of the side plate 302, as shown in FIG. 26. This feature is believed to increase the stiffness of the side plates 302.

The carriage 300 also comprises two upper support bars 308. Each upper support bar 308 is secured to an upper end of a corresponding one of the side plates 302 by a suitable means such as welding. The upper support bars 308 are connected by two alignment bars 310, located on opposite sides of the carriage 300. A strip of ultra-high molecular weight polyurethane or other suitable material (not shown) can be secured to the outwardly-facing surface of each alignment bar 310. These strips can contact the associated side panel 237 of the support structure 234, so as to center the carriage 300 within the support structure 234.

The carriage 300 also includes two slides 314. Each slide 314 is secured to the underside of an associated upper support bar 308 and alignment bar 310. The carriage 300 is positioned within the support structure 234 so that the slides 314 rest on the bearing strip 293 on an associated one of the upper support tracks 290. The slides 314 preferably are formed from steel.

Figure 25:
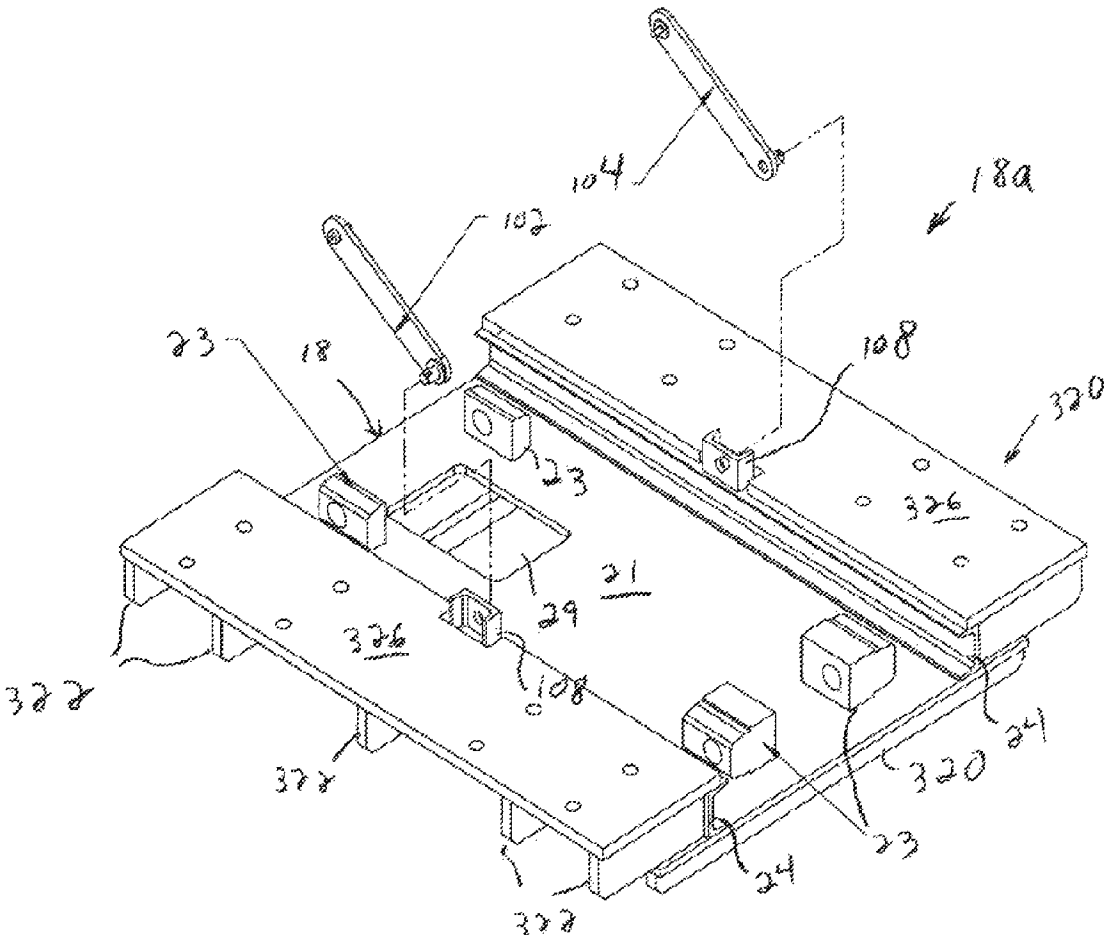
FIG. 25 is a perspective view of a base of the lifting device shown in FIGS. 16, 18, 20, 22, and 23.

The device 10*a* includes a base 18*a* (see FIG. 25). The base 18*a* is a modified version of the base 18 described above. Components of the base 18*a* that are substantially identical to those of the base 18 are denoted by identical reference characters in the figures.

The base 18*a* includes a plurality of stiffeners 320 secured to a lower surface of the base plate 21, by a suitable means such as welding. The base 18*a* also includes a plurality of gussets 322 secured to an upper surface of the base plate 21, outboard of the channels 24, by a suitable means such as welding. The base 18*a* further comprises two flanges 326 secured to upper surfaces of the gussets 322 by a suitable means such as welding. Each flange 326 can be secured to an associated lower support bar 306 of the carriage, to suspend the device 10*a* from the carriage 300 as shown in FIG. 26.

The carriage 300 preferably is driven by a hydraulically-powered motor 270, and a drive gear assembly 272 (see FIG. 27). (Other types of drive systems, including electric motors, can be used in the alternative.) The motor 270 and the drive gear assembly 272 are secured to one of the side plates 302 of the carriage 300 by a suitable means such as fasteners.

Actuation of the motor 270 is a forward or reverse direction can be controlled by the user from the control console. Actuation of the motor 270 imparts rotation to gears 272*a* of the drive gear assembly 272. The gears 272*a* engage the teeth formed on an associated gear track 295. The interaction between the gears 272*a* and the gear tracks 295 imparts linear movement to the carriage 300 and the device 10*a*, in the directions denoted by the arrows 248 in FIG. 21.

The lines that route hydraulic fluid to and from the hydraulic actuator 62 of the device 10*a* preferably are housed, in part, within a carrier 280. A first end of the carrier 280 is secured to the carriage 300. A second end of the carrier 280 is secured to one of the side panels 237. The carrier 280 preferably is formed from a plurality of pivotally connected links that can deflect in a repeatable, predetermined manner as the carriage 300 translates, so as to prevent the hydraulic lines from tangling or otherwise becoming damaged.

Figure 21A:
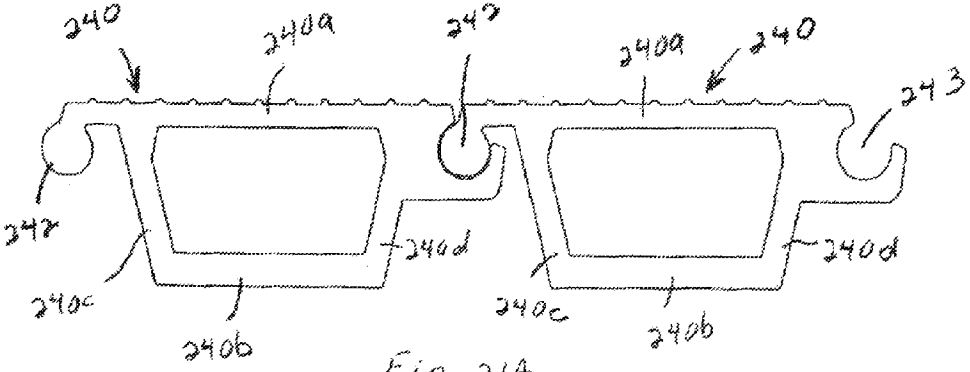
FIGS. 21A and 21B are side views of two cover elements of the cover shown in FIG. 20, depicting the manner in which the cover elements can articulate with respect to each other.
Figure 21B:
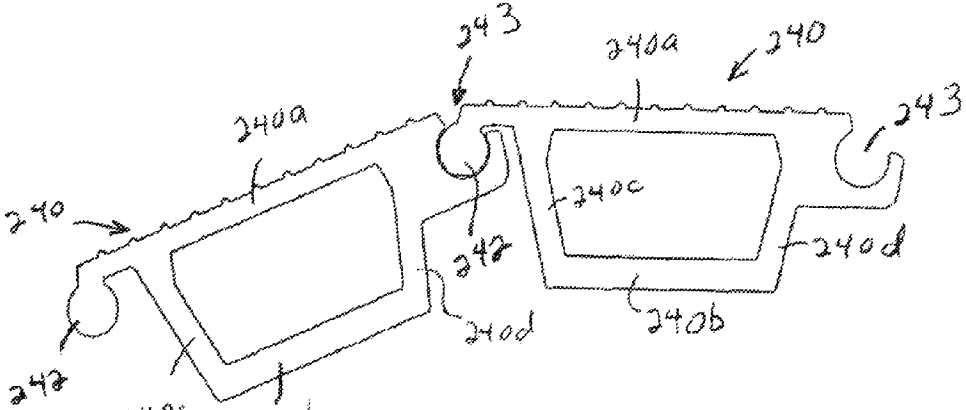

The cover 232 comprises a plurality of beams, or cover elements 240 (see FIGS. 21A, 21B, and 22). The cover elements 240 are preferably formed from extruded 6061 aluminum.

The cover elements 240 each preferably comprise a first major portion 240*a*, a second major portion 240*b*, and first and second side portions 240*c*, 240*d*. The first and second side portions 240*c*, 240*d* adjoin each of the first and second major portions 240*a*, 240*b*, so that the first and second major portions 240*a*, 240*b* and the first and second side portions 240*c*, 240*d* form an isotropic beam.

The cover elements 240 are supported by the upper and lower tracks 290, 292. In particular, opposing ends of the major portion 240*a* of each cover element 240 can rest on the bearing strips 295 of the associated upper or lower tracks 290, 292.

Each cover element 240 includes mating features that pivotally couple the cover element 240 to adjacent cover elements 240. For example, each cover element 240 can include a substantially rod-shaped member 242 the extends from a leading (or trailing) end of the first major portion 240, as shown in FIGS. 21A and 21B. Each cover element 240 can have a recess 243 defined therein, proximate the trailing (or leading) end thereof. The recess 243 is shaped to receive and retain the member 242 of the adjacent cover member 240.

Moreover, the configuration of the recess 243 permits the member 242 to rotate about its longitudinal axis within the recess 243.

Movement of the cover 232 in one direction causes the cover elements 240 located to one side of the lifting device 10*a* to be pushed from the upper tracks 290 to the lower tracks 292 by way of the channel 296 in the radius end plates 294 located proximate one end of the support structure 234. The cover elements 240 located on the other side of the lifting device 10*a* are simultaneously pulled from the lower tracks 292 to the upper tracks 294 by way of the channels 296 in the radius end plates 294 located proximate a second end of the support structure 294.

The mating features of the cover elements 240, i.e., the members 242 and the recesses 243, permit the cover elements 232 to move in a substantially curvilinear path along the channels 296 of the radius end plates 294.

The depth of the channels 296 preferably varies along a length thereof, as noted above. This feature results in a centering force on the cover elements 240 as the cover elements 240 travel along the channels 296.

The cover elements 240 are preferably designed to withstand a 7,500-pound point load, so that the cover 232 can withstand a drive over by one tire of a relatively heavy vehicle such as the bus 200.

The ability of the cover 232 to move with the carriage 300 and the device 10*a* permits the lifting device 10*a* to be lowered to its retracted position (below the level of the surrounding floor) regardless of its position within the front pit 202. A typical conventional lift, by contrast, can be fully lowered in only one particular position, due to the need for cut outs or other means to accommodate the relatively wide superstructure and relatively narrow pit associated with such a lift. The ability to fully retract the lifting device 10 regardless of its position in the pit 202, it is believed, makes the lifting device 10 particularly well suited for use with relatively low-wheel-base vehicles such as low-floor transit buses.

Two side panels 298, and two end panels 299 can be secured to the support structure 234 as depicted in FIG. 24, to cover gaps between the cover elements 240 and the shop floor.

The lifting device 10*b* is depicted as being installed in the rear pit 204 without a support structure. The lifting device 10*b* can be installed in a support structure tailed to the dimensions of the rear pit 204, in alternative embodiments.

FIGS. 34A-34F depict another type of installation incorporating the lifting device 10. In particular, FIGS. 26A-26F show the lifting device 10 having a platform 210 secured to a bolster 20*a* thereof. The platform 210 accommodates a vehicle, i.e., a vehicle can be driven onto the platform 210. The platform 210 (and the vehicle thereon) can then be raised by the lifting device 10. (This particular type of installation is believed to be suited for lifting light-weight and medium-weight vehicles, i.e., vehicles weighing up to approximately 15,000 pounds. It should be noted that specific capacities for various applications of the lifting device 10 are presented for exemplary purposes only; alternative embodiments of the lifting device 10 can be constructed with capacities greater or less than those specified herein.)

FIGS. 35A-35D depict another type of installation incorporating the lifting device 10. This particular installation includes a platform 214 secured to the respective bolsters 20*b* of two of the lifting devices 10. A vehicle can be driven onto the platform 214, and the platform 210 vehicle can be raised by the lifting devices 10. (This particular type of installation is believed to be suited for lifting medium-weight and heavy vehicles.)

FIGS. 36A-36F depict an installation incorporating four of the lifting devices 10 and two substantially rectangular platforms 220. One of the platforms 220 is secured to the respective bolsters 20*c* of two of the lifting devices 10. The other of the platforms 220 is secured to the respective bolsters 20*c* of the other two lifting devices 10. (This particular type of installation is believed to be suited for relatively heavy vehicles, i.e., vehicles weighing up to approximately 75,000 pounds.)

FIGS. 37A-37D depict the lifting device 10 configured with four swing arms 222. The swing arms 222 are pivotally coupled to a bolster 20*d* of the lifting device 10 so that the positions of the swing arms 222 in relation to the bolster 20*d* can be adjusted. The swing arms 222 can be positioned to engage a frame or pinch welds of a vehicle positioned over the lifting device 10 as the lifting device 10 is extended.

FIGS. 38A-38D depict two of the lifting devices 10 having two of the swing arms 222 pivotally coupled to respective bolsters 20*e* thereof.

The lifting device 10, as described herein, is believed to have a lifting capacity of approximately 30,000 pounds (applications incorporating two of the lifting devices 10 can thus lift approximately 60,000 pounds). The lifting device 10 can extend approximately seventy inches. The lifting device 10 is relatively compact when in its retracted position (the lifting device 10 has a footprint of approximately forty inches by approximately twenty-two inches (as viewed from above), and is approximately twenty-four inches tall). Hence, the lifting device 10 can be accommodated in a relatively shallow pit such as the pit 202. In particular, it is believed that the required depth for the pit 202 is less than half the depth of the trench or hole needed to accommodate the hydraulic cylinder of a conventional hydraulically-powered lift of comparable capacity. It should be noted that the dimensions of the lifting device 10 are application dependent; specific dimensions are specified herein for exemplary purposes only.

The lifting device 10 is believed to be more stable than other types of lifting devices of comparable capacity. The lifting device 10 is preferably oriented laterally in relation to the vehicle being lifted as shown, for example, in FIGS. 16 and 17. Orienting the lifting device 10 laterally is believed to maximize access to the underside of the vehicle positioned on the lifting device 10.

The lifting device 10, it is believed, requires less hydraulic fluid than other types of lifting devices of comparable capacity. For example, the lifting device 10 requires approximately seven gallons of hydraulic fluid (alternative embodiments may require more or less than this amount of fluid). The relative low amount of hydraulic fluid required by the device 10 can lower the potential for ground contamination caused by leakage or spillage of the hydraulic fluid.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein. Moreover, specific dimensions and capacities for the lifting device 10 have been specified for exemplary purpose only.

Alternative embodiments of the lifting device 10 can have dimensions and capacities other than those specified herein.

What is claimed is:

1. A method for lifting a motor vehicle, comprising:

positioning the motor vehicle so that a first axle of the motor vehicle is located directly above a first scissors lift located in an opening in the ground, and a second axle of the motor vehicle is located over a pit having a second scissors lift located therein, the first and second scissor lifts defining a forward-rearward direction, each of the first scissor lift and the second scissor lift being configured for up and down movement, the first scissor lift being fixed in the forward-rearward direction;

positioning the second scissors lift by moving the second scissor lift along the forward-rearward direction in the pit so that the second scissors lift is located directly beneath the second axle, and whereby a cover moves in the forward-rearward direction upon forward-rearward movement of the second scissor lift such that the cover lies over the pit at all positions of the second scissor lift along the forward-rearward direction; and extending the first and second scissors lifts so that the first and second scissors lifts urge the respective first and second axles upward.

2. The method of claim 1, wherein extending the first and second scissors lifts so that the first and second scissors lifts urge the respective first and second axles upward comprises extending the first and second scissors lifts so that an accessory adapter of a mating assembly of the first scissors lift contacts the first axle and exerts an upward force on the first axle, and an accessory adapter of a mating assembly of the second scissors lift contacts the second axle and exerts an upward force on the second axle.

3. The method of claim 1, further comprising the first and second scissors lifts so that the first and second scissors lifts release the first and second axles and retract fully below ground.

4. The method of claim 1, wherein extending the first and second scissors lifts so that the first and second scissors lifts urge the respective first and second axles upward comprises extending each of the first and second scissors lifts approximately seventy inches.

5. The method of claim 1, wherein extending the first and second scissors lifts so that the first and second scissors lifts urge the respective first and second axles upward comprises extending the first and second scissors lifts by at least approximately seventy inches.

6. The method of claim 1, wherein extending the first and second scissors lifts so that the first and second scissors lifts urge the respective first and second axles upward comprises extending the first and second scissors lifts so that the first and second scissors lifts urge the respective first and second axles upward to provide personnel access to an underside of the motor vehicle.

7. The method of claim 1, wherein said cover is configured to be both fixed and adjustably movable.

8. The method of claim 1, wherein the cover includes first and second cover portions, the first cover portion is discrete and spaced apart from the second cover portion, the first cover portion having a proximal end that is coupled to a moveable carriage that houses the second scissor lift, the second cover portion having a proximal end that is coupled to the carriage opposite the first cover portion, each one of the first cover portion having a distal end that is opposite the proximal end, the second cover portion having a distal end that is opposite the proximal end, the distal end of the first cover portion is spaced apart from the distal end of the second cover portion.

9. The method of claim 1, wherein each one of the first and second scissor lifts includes a lower tier comprising:

a lower leg structure having a relatively large width at its upper end and a relatively small width at its lower end, and two first leg leaves pivotally coupled to the lower leg structure, the lower leg structure and the lower leg leaves being pivotally coupled to the base;

a middle tier comprising:

a middle leg structure member pivotally coupled to the lower leg leaves, and two middle leg leaves pivotally coupled to the lower and middle leg structures;

an upper tier comprising:

an upper leg structure having relatively small width at its upper end and a relatively large width at its lower end, the upper leg structure being and pivotally coupled to the second middle leg leaves, and two upper leg leaves pivotally coupled to the middle and upper leg structures;

a cylinder operatively coupled to actuate the tiers from a retracted position to an extended position, and a bolster pivotally coupled to the upper leg structure weldment and the upper leg leave.

10. The method of claim 1, wherein each one of the scissor lifts includes three scissor tiers including a lower tier, a middle tier, and an upper tier;

the lower tier pivotably coupled to the base, the lower tier including:

a pair of lower leg leaves, and a lower leg structure pivotably coupled to the lower leg leaves, the lower leg structure includes:

a pair of parallel legs; each one of the legs having an upper portion having a relatively large width and a lower portion having a relatively small width; each one of the upper portions is adapted to receive a first pin; and a cross member rigidly attached between the legs;

the middle tier pivotably coupled to the lower tier, the middle tier including:

a pair of lower leg leaves; and a middle leg structure;

the upper tier pivotably coupled to the middle tier, the upper tier including:

a pair of upper leg leaves, and an upper leg structure pivotably coupled to the upper leg leaves, the upper leg structure includes:

a pair of parallel legs; each one of the legs having an upper portion having a relatively small width and a lower portion having a relatively large width; each one of the lower portions is adapted to receive a second pin; and a cross member rigidly attached between the legs.

11. The method of claim 10, the cross member in the lower leg structure is located between lower portions of the legs.

12. The method of claim 10, wherein the cross member in the upper leg structure is located between upper portions of the legs.

13. The method of claim 10, the lower leg structure further includes a mid-section having a thickness dimension that is between the relatively large-width upper portion and the relatively small-width lower portion.

14. The scissor lift device of claim 13, wherein the upper leg structure further includes a mid-section having a thickness dimension that is between the relatively small-width upper portion and the relatively large-width lower portion.

15. The scissor lift device of claim 14, wherein the lower leg structure uniformly tapers from the relatively large-width part to the relatively small-width part.

16. The scissor lift device of claim 15, wherein the upper leg structure uniformly tapers from the relatively large-width part to the relatively small-width part.

17. The method of claim 1, wherein the lift is configured to lift heavy vehicles.

18. The method of claim 1, wherein the up and down movement is extension and contraction of the scissor lifts between a fully retracted position and a fully extended position; such that, when the scissor lifts are in the fully retracted position, a lower portion of each scissor lift is located below ground level and an uppermost portion of each scissor lift is near ground level and such that, when the scissor is in the fully extended position, the scissor has a portion below ground level defining a depth of the scissor and a portion above ground level defining a height of the scissor, the depth of the scissor being less than the height of the scissor when in the fully extended position.

19. The method of claim 18, wherein the pit has a depth that is less than half the depth of a pit required to accommodate a vertical hydraulic cylinder of a conventional hydraulic vehicle lift having comparable lift height.

20. The method of claim 18, wherein each scissor has a lift capacity of at least approximately 30,000 pounds.

21. The method of claim 1, wherein first and second scissor lifts each (i) include tiers capable of being actuated by a cylinder, (ii) being moveable between a fully retracted position and a fully extended position, and (iii) being capable of being located below ground level when in the fully retracted position such at an uppermost portion of the scissor is near ground level; the pit having less than half the depth of a prior art trench having a vertical hydraulic cylinder of a conventional hydraulically-powered lift of comparable capacity.

22. The method of claim 1, wherein the second scissor lift is supported by a carriage, the cover including a first cover coupled to a first side of the carriage and a second cover coupled to an opposing second side of a carriage, each one of the first cover and the second cover overlying the pit and extending in the forward-rearward direction away from the carriage such that the first cover and the second cover are configured to move in a reciprocal motion with the second scissor lift, the second scissor lift being moveable between the retracted and extended positions at multiple forward-rearward positions.

23. The method of claim 22, wherein the pit has a depth below ground that is less the scissor lift height above ground when the scissor lift is in the extended position.

24. The method of claim 22, wherein the lift capacity of each scissor lift is approximately 30,000 pounds.

25. The method of claim 1 wherein the first positioning step includes positioning the motor vehicle relative to additional scissor lifts.

26. The method of claim 1 wherein the first scissor lift is located in a pit that is spaced apart from the pit of the second scissor lift.

* * * * *

UNITED STATES PATENT AND TRADEMARK OFFICE

CERTIFICATE OF CORRECTION

PATENT NO. : 8,523,146 B2
APPLICATION NO. : 13/468379
DATED : September 3, 2013
INVENTOR(S) : Kurt E. Polins et al.

It is certified that error appears in the above-identified patent and that said Letters Patent is hereby corrected as shown below:

In the Claims

Col. 18, line 61, (claim 14), delete "scissor lift device" and substitute therefor --method--

Col. 18, line 65, (claim 15), delete "scissor lift device" and substitute therefor --method--

Col. 19, line 1, (claim 16), delete "scissor lift device" and substitute therefor --method--

Signed and Sealed this
Third Day of March, 2015

Michelle K. Lee

Michelle K. Lee
*Deputy Director of the United States Patent and Trademark Office*